US006157010A

United States Patent [19]

Mine

[11] Patent Number: 6,157,010

[45] Date of Patent: Dec. 5, 2000

[54] HEATER CONTROL DEVICE

[75] Inventor: Ryuta Mine, Mishima, Japan

[73] Assignee: Canon Kabushiki Kaisha, Tokyo, Japan

[21] Appl. No.: 09/069,249

[22] Filed: Apr. 29, 1998

[30] Foreign Application Priority Data

Apr. 30, 1997 [JP] Japan ..... 9-112748
Apr. 24, 1998 [JP] Japan ..... 10-114848

[51] Int. Cl.[7] ..... H05B 1/02

[52] U.S. Cl. ..... 219/501; 219/216; 219/497; 219/492; 323/238; 323/908

[58] Field of Search ..... 219/216, 501, 219/497, 499, 505, 492; 323/238, 235, 236, 908

[56] References Cited

U.S. PATENT DOCUMENTS 3,947,751 3/1976 Bray ..... 323/9
4,785,390 11/1988 Zelina et al. ..... 323/238
5,479,086 12/1995 Konstanzer et al. ..... 323/238

FOREIGN PATENT DOCUMENTS 0 373 678 A1 6/1990 European Pat. Off. .
0 420 523 A2 4/1991 European Pat. Off. .
0 740 223 A2 10/1996 European Pat. Off. .
59-206915 11/1984 Japan .
4-204879 7/1992 Japan .
9-106215 4/1997 Japan .

*Primary Examiner*—Mark Paschall
*Attorney, Agent, or Firm*—Fitzpatrick, Cella, Harper, & Scinto

[57] ABSTRACT

A heater control device that prevents a flickering by driving a fixing heater in a phase controlling at a fixed phase angle for predetermined duration when an image forming apparatus starts power supplying to the fixing heater.

13 Claims, 16 Drawing Sheets

Lin1

DRIVE PULSE

Lin1rms ein
F

Ts
Tb
Tc
Ta a b c
P3
P4 c1 e
t6
t7
t8
t9
t10

Vin
F

Ts
Tb
Ta c d1 a
taon
taoff
taon
taoff a
taoff
taon
taoff
taon b1
ton1
toff1
ton1
toff1 b2
ton2
toff2
ton2
toff2 c d1 e1
Pe2
Pe2 f1
Pe1 g1
tp1
tp1 g2 a
taoff
taon
taoff b1
ton1
toff1
ton1
toff1 b2
toff2
ton2
toff2
ton2 c d1 e21 f21
tp2
tp3 g1 g2

Lin2

DRIVE PULSE

Lin2rms

HEATER CONTROL DEVICE

BACKGROUND OF THE INVENTION

1. Field of the Invention

The present invention relates to a heater control device for supplying a current to a heater to heat a load.

2. Description of the Related Art

In an image forming apparatus, such as a copying machine and a printer, using an electrophotographic process, an electrostatic latent image formed on a photoconductive drum (rotary photoconductor body) is converted into a visible image (hereinafter referred to as a toner image) by making a development agent (hereinafter referred to as toner) to adhere thereto through a development unit. The toner image is transferred to a recording paper sheet through a transfer unit, and the toner image is then fixed to the recording paper sheet through a fixing unit to form a permanent image thereon.

The fixing unit typically employs a thermal fusing fixing method, in which the toner is fused by thermal energy from a fixing roller heated by a heater as a heat source so that the toner is fused into the fiber of the recording paper sheet under the pressure of the fixing roller.

FIG. 15 is a block diagram showing a major portion of a conventional image forming apparatus which controls power supplying to a fixing heater which is used as a heat source in a fixing unit of thermal fusing fixing type.

Referring to FIG. 15, an alternating current power is supplied across input terminals 1 and 2 connected to an alternating current utility power line. Connected between the input terminals 1 and 2 is a series network, consisting of a fixing heater 3 and a switching element 4, to which the alternating current utility power is supplied. The fixing heater 3 is housed in an unshown fixing roller and is extended in the axial direction of the fixing roller. A halogen lamp with a power rating of several hundred W to 1 kW and with a resistance of a positive temperature coefficient is typically used for the heater. A solid-state relay (SSR) or an insulated switch circuit constructed of a phototriac and a triac may be used for the switching element 4.

A zero crossing detector circuit 6, connected across the series circuit, detects the zero crossings of the alternating current utility power supplied to the series circuit between the input terminals 1 and 2. A temperature sensor 5 is arranged in the close vicinity of the surface of the fixing roller, and is typically a thermistor with an impedance having a known temperature coefficient. This arrangement allows the temperature of the surface of the fixing roller to be constantly detected, and a detected temperature signal is output to a temperature adjusting circuit 7.

The temperature adjusting circuit 7 controls the switching element 4 for switching in response to the detected temperature signal, thereby controlling the on/off timings of the fixing heater 3. The temperature adjusting circuit 7 outputs heater on/off signals for temperature control to a drive pulse generator 12 to keep the temperature of the surface of the fixing roller to within a predetermined temperature control range. More specifically, the temperature adjusting circuit 7 outputs an off signal when the surface temperature of the fixing roller rises to the upper limit of the predetermined temperature control range and outputs an on signal when the surface temperature of the fixing roller drops to the lower limit of the predetermined temperature control range.

Receiving the heater on/off signals and the output of the zero crossing detector circuit 6, the drive pulse generator 12 outputs a drive pulse to the switching element 4 to control the surface temperature of the fixing roller to within the predetermined temperature control range.

The operation of the circuit arrangement shown in FIG. 15 is now discussed.

When the alternating current utility power is supplied across the input terminals 1 and 2, an unshown power supply circuit rectifies it to a direct current power to energize the above-described circuits 4, 6, 7 and 12. The temperature sensor 5 detects the surface temperature of the fixing roller and outputs the detected temperature signal to the temperature adjusting circuit 7. The temperature adjusting circuit 7 outputs the on signal to the drive pulse generator 12 when the detected surface temperature of the fixing roller drops below the lower limit of the predetermined temperature control range and outputs the off signal to the drive pulse generator 12 when the surface temperature of the fixing roller gradually rises and reaches the upper limit of the predetermined temperature control range.

The zero crossing detector circuit 6 continuously monitors the alternating current utility power to detect its zero crossings, and outputs the zero crossing signal to the drive pulse generator 12.

In response to the on signal and off signal coming in from the temperature adjusting circuit 7, the drive pulse generator 12 generates and outputs the drive pulse to the switching element 4 in synchronization with the zero crossing signal output by the zero crossing detector circuit 6, thereby causing switching element 4 to switch on and off. The switching element 4 is thus controlled. The switching action of the switching element 4 controls intermittent conduction timings of the fixing heater 3.

The current flowing from the alternating current utility power line to the fixing heater 3 is controlled such that it always starts to flow in synchronization with the zero crossing of the alternating current utility power. The fixing roller is controlled such that its surface temperature is kept to within a predetermined temperature control range.

FIGS. 16A–16C are waveform diagrams showing the relationship between the current flowing through the fixing heater 3 and the drive pulse.

FIG. 16A shows a waveform Lin2 flowing through the fixing heater 3, where F represents one period of the alternating current frequency. FIG. 16B shows the drive pulse, in which the switching element 4 remains on during a high level (ton) and remains off during a low level (toff). FIG. 16C shows the root-mean-square value of Lin2rms into which the current wave Lin2 is converted every half period of the alternating current frequency.

Since the switching element 4 remains off during the toff period, the fixing heater 3 is not powered, with no current supplied. The fixing heater 3 is housed in the fixing roller. The fixing roller has a larger thermal capacity while the fixing heater 3 has a smaller one. For this reason, the surface temperature of the fixing roller slowly drops while the temperature of the fixing heater 3 rapidly drops. The fixing heater 3 drops in temperature during the toff period because it generates no heat and its resistance is extremely small during this period.

The drive pulse is now driven high to a high level with the surface temperature of the fixing roller lowered. The fixing heater 3 is supplied with the alternating current utility power. This means that the utility power is fed to an extremely low resistance. At the start of power feeding, a very large rush current flows in contrast to the stationary state shown in FIG. 16A. As the resistance increases with the fixing heater 3 rising in temperature during the ton period, the current stabilizes to the stationary state shown in FIG. 16A.

The root-mean-square value Lin2rms converted from the current waveform Lin2 changes as shown in FIG. 16C. The root-mean-square value $RS_3$ corresponding to the rush current, in contrast to a root-mean-square value ST converted during the stationary state, is greatly dependent on the temperature control range of the fixing roller (the range from a lower temperature limit above which the fixing heater 3 is powered to an upper temperature limit above which power is removed from the fixing heater 3). The root-mean-square value is greatly dependent on the lengths of the high-level period and low-level period of the drive pulse. Specifically, a shorter low-level period results in a lower rush current peak value $RS_3$ and a longer low-level period results in a higher rush current peak value $RS_3$. When the low-level period gets longer than a predetermined duration, the fixing heater 3 fully drops, saturating the value $RS_3$. In the example shown in FIGS. 16A–16C, the rush current peak value $RS_3$ flowing through the fixing heater 3 at the moment the switching element 4 is transitioned from off to on becomes several times as great as the stationary root-mean-square value ST.

In the image forming apparatus such as a printer or copying machine having such a heater control circuit therewithin, the peak current represented by $RS_3$ flows at the moment the supplying of the alternating current utility power starts. Unless the impedance of the interior wiring for feeding the alternating current utility power is sufficiently low, a large voltage drop instantaneously takes place through the impedance in the alternating current utility power supply. This possibly adversely affects other apparatuses that share the same line for the alternating current utility power. As one of such examples, an instantaneous voltage drop causes a flickering in which illuminance level of lighting equipment drops momentarily. To prevent such a voltage drop, the impedance of the power line may be lowered or a complex and costly circuit arrangement may be used.

Although the use of two heaters for the fixing unit is contemplated, such a fixing unit equally suffers the same problem.

SUMMARY OF THE INVENTION

It is an object of the present invention to provide a heater control device and heater control method free from the above problem.

It is another object of the present invention to provide a heater control device and heater control method in which the root-mean-square value of a rush current at the power on of a heater is limited by the use of simple and low-cost arrangement.

It is yet another object of the present invention to provide a heater control device and heater control method in which a voltage drop at the moment of power on is reduced.

It is yet another object of the present invention to provide a heater control device and heater control method in which a flickering is alleviated.

Other objects of the present invention will be apparent from the following description, the accompanying drawings and the appended claims.

DESCRIPTION OF THE PREFERRED EMBODIMENTS

Figure 1:
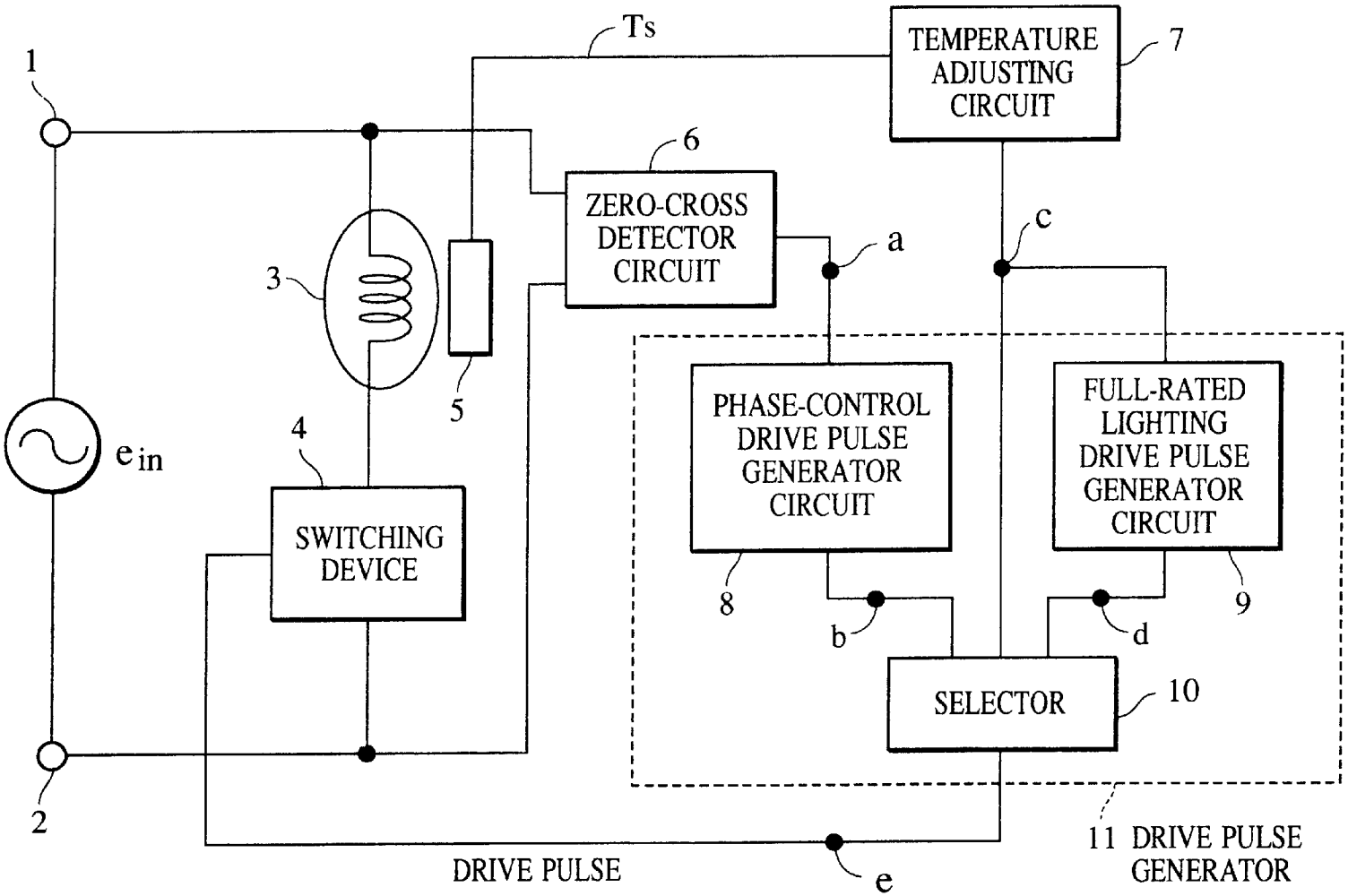
FIG. 1 is a block diagram showing a major portion of a first embodiment of image forming apparatus of the present invention.

Referring to the drawings, the embodiments of the present invention are now discussed.

First embodiment

FIG. 1 is a block diagram showing a major portion of a first embodiment of image forming apparatus of the present invention.

Referring to FIG. 1, an alternating current power is supplied across input terminals 1 and 2 connected to an alternating current utility power line. Connected between the input terminals 1 and 2 is a series network, consisting of a fixing heater 3 and a switching element 4, to which the alternating current utility power is supplied. The fixing heater 3 is housed in an unshown fixing roller and is extended in the axial direction of the fixing roller. A halogen lamp with a power rating of several hundred W to 1 kW and with a resistance of a positive temperature coefficient is typically used for the heater. A solid-state relay (SSR) or an insulated switch circuit constructed of a phototriac and a triac may be used for the switching element 4. The fixing roller fixes the toner image, transferred onto a recording medium, to the recording medium.

A zero crossing detector circuit 6, connected across the series circuit, detects the zero crossings of the alternating current utility power supplied to the series circuit between the input terminals 1 and 2. A temperature sensor 5 is arranged in the close vicinity of the surface of the fixing roller, and is typically a thermistor with an impedance having a known temperature coefficient. This arrangement allows the temperature of the surface of the fixing roller to be constantly detected, and a detected temperature signal is output to a temperature adjusting circuit 7.

The temperature adjusting circuit 7 controls the switching element 4 for switching in response to the detected temperature signal, thereby controlling the on/off timings of the fixing heater 3. Specifically, the temperature adjusting circuit 7 outputs a heater on/off signal for temperature control to keep the temperature of the surface of the fixing roller to within a predetermined temperature control range. More specifically, the temperature adjusting circuit 7 outputs to a full-rated lighting drive pulse generator circuit 9 and a selector 10, both constituting a drive pulse generator 11, a signal which is transitioned to a low level when the surface temperature of the fixing roller rises and reaches the upper limit of a temperature control range, and which is transitioned to a high level when the surface temperature of the fixing roller drops and reaches the lower limit of the temperature control range. The drive pulse generator 11 further includes a phase-control drive pulse generator circuit 8.

The full-rated lighting drive pulse generator circuit 9 delays the output of the temperature adjusting circuit 7 by a predetermined duration, and outputs to the selector 10 the delayed signal as a full-rated lighting drive pulse. Receiving the output of the zero crossing detector circuit 6, the phase-control drive pulse generator circuit 8 outputs a phase-control drive pulse to the selector 10.

The selector 10 selects one of the heater on/off signal, the phase-control drive pulse and the full-rated lighting drive pulse based on the output signals of the temperature adjusting circuit 7 and the full-rated lighting drive pulse generator circuit 9, and outputs the selected signal as a drive pulse to be used in the switching element 4. The drive pulse controls the switching element 4 for switching. Based on the switching timing of the switching element 4, a current intermittently flows through the fixing heater 3, thereby keeping the surface temperature of the fixing roller to within the predetermined temperature control range.

The operation of the circuit arrangement in FIG. 1 is discussed referring to a timing diagram shown in FIGS. 2A–2G.

Figures 2A, 2B, 2C, 2D, 2E, 2F, 2G:
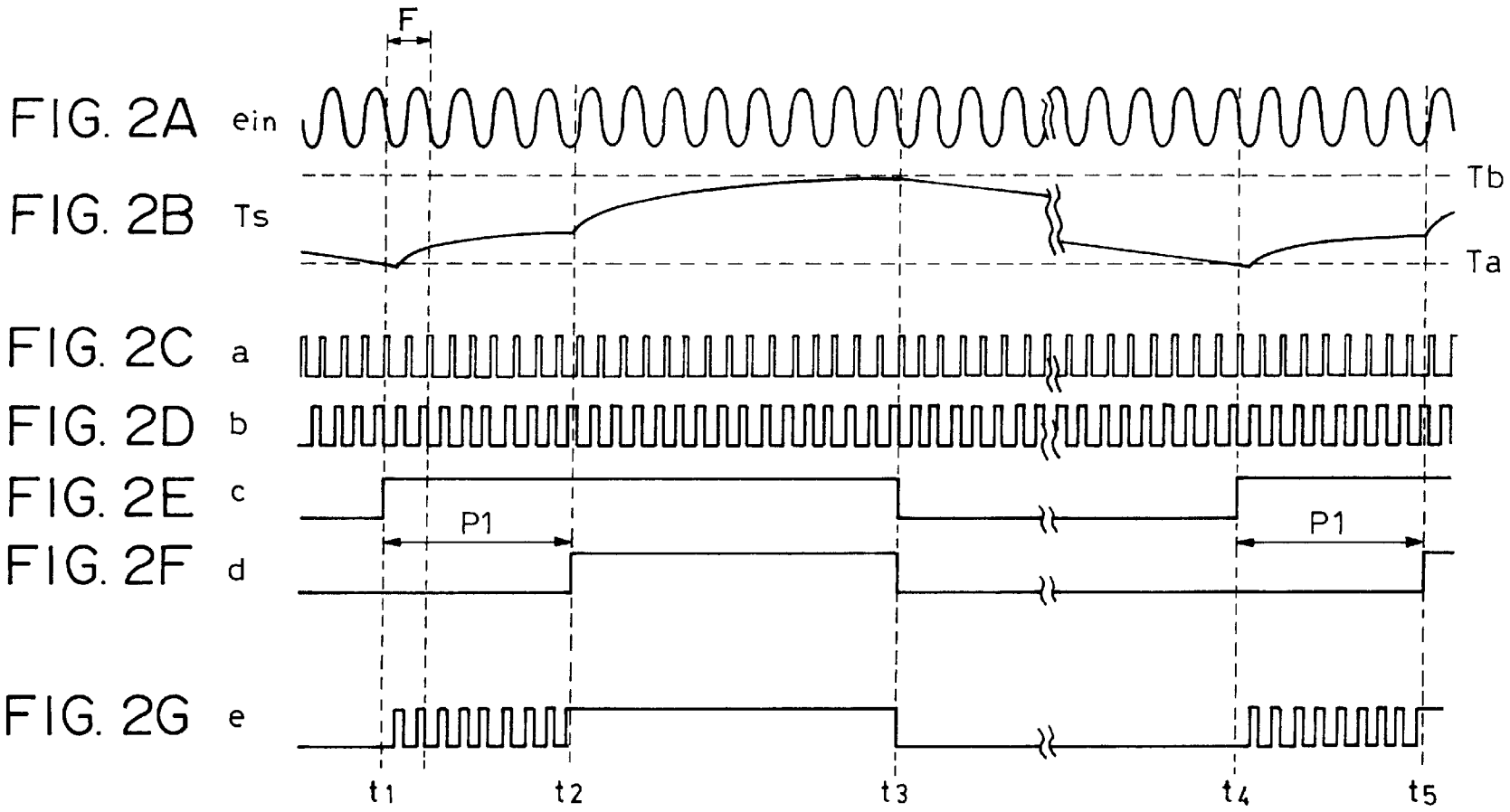
FIGS. 2A–2G are timing diagrams showing signals in the circuit arrangement shown in FIG. 1.

FIG. 2A shows an alternating current utility power supply voltage $e_{in}$ supplied between the input terminals 1 and 2, wherein F represents one period of the alternating current utility power. FIG. 2B shows a detected temperature Ts detected by the temperature sensor 5, in which Ta represents the lower limit of the control range of the surface temperature of the fixing roller set by the temperature adjusting circuit 7, and Tb represents the upper limit of the control range. FIG. 2C shows the waveform of the zero crossing signal, at a point a, output by the zero crossing detector circuit 6 in FIG. 1. FIG. 2D shows the waveform of the phase-control drive pulse, at a point b, output by the phase-control drive pulse generator circuit 8 in FIG. 1. FIG. 2E shows the heater on/off signal, at a point c, output by the temperature adjusting circuit 7 in FIG. 1. FIG. 2F shows the waveform of the full-rated lighting drive pulse, at a point d, output by the full-rated lighting drive pulse generator circuit 9 in FIG. 1. FIG. 2G shows the waveform of the signal, at a point e, output by the selector 10 in FIG. 1.

When the alternating current utility power is supplied between the input terminals 1 and 2, an unshown power supply circuit rectifies it into a direct current to power the above circuits 4, 6, 7, 8, 9 and 10. The temperature sensor 5 detects the surface temperature of the fixing roller, and outputs the detected temperature signal Ts to the temperature adjusting circuit 7. The temperature adjusting circuit 7 outputs the heater on/off signal (FIG. 2E), which is transitioned to a high level when the detected surface temperature of the fixing roller drops below the lower limit of the predetermined control range and which is transitioned to a low level when the detected surface temperature rises above the upper limit of the predetermined control range.

The zero crossing detector circuit 6 constantly monitors the alternating current utility power supply voltage $e_{in}$ (FIG. 2A) across the input terminals 1 and 2 to detect the zero crossings of the supply voltage, and outputs the zero crossing signal (FIG. 2C) to the phase-control drive pulse generator circuit 8. In response to the zero crossing signal, the phase-control drive pulse generator circuit 8 outputs the phase-control drive pulse (FIG. 2D).

Receiving the heater on/off signal from the temperature adjusting circuit 7, the full-rated lighting drive pulse generator circuit 9 outputs the full-rated lighting drive pulse (FIG. 2F) that is transitioned to a high level at $t_2$ ($t_5$) with a fixed duration (P1 in FIG. 2F) delayed from $t_1$ ($t_4$) at which the heater on/off signal rises. The falling timing of the full-rated lighting drive pulse and the heater on/off signal are synchronized with the zero crossing at $t_3$.

The selector 10 receives the heater on/off signal, the phase-control drive pulse and the full-rated lighting drive pulse from the temperature adjusting circuit 7, the phase-control drive pulse generator circuit 8 and the full-rated lighting drive pulse generator circuit 9, respectively.

The selector 10 drives the drive pulse (FIG. 2G) low during the low-level period of the heater on/off signal to turn off the switching element 4, thereby deactivating the fixing heater 3. The selector 10 outputs the drive pulse to the switching element 4 to activate the fixing heater 3 during the high-level period of the heater on/off signal.

The drive pulse generator 11 outputs the phase-control drive pulse during the fixed duration P1 from $t_1$ at the moment a conductive state starts with the heater on/off signal remaining high through to $t_2$, but outputs the full-rated lighting drive pulse during the remaining time (from $t_2$ to $t_3$) of the high-level period. The phase-control drive pulse remains high in a duration shorter than the period F of the alternating current utility power in synchronization with the zero crossing signal. During the fixed duration P1, the switching element 4 is turned on during the high-level duration of the phase-control drive pulse. Throughout the remaining time of the conductive state, the switching element 4 is continuously turned on.

The switching element 4 is controlled in this manner, and the fixing heater 3 is powered accordingly. When the surface temperature of the fixing roller drops and reaches the lower limit Ta, the fixing heater 3 becomes conductive. When the surface temperature of the fixing roller rises and reaches the upper limit Tb, the fixing heater 3 becomes nonconductive. The fixing roller is thus controlled in temperature to within the predetermined temperature control range. The term conductive state refers to the state in which the fixing heater 3 is heated and the conductive state period includes the fixed duration P1.

Figures 3A, 3B, 3C:
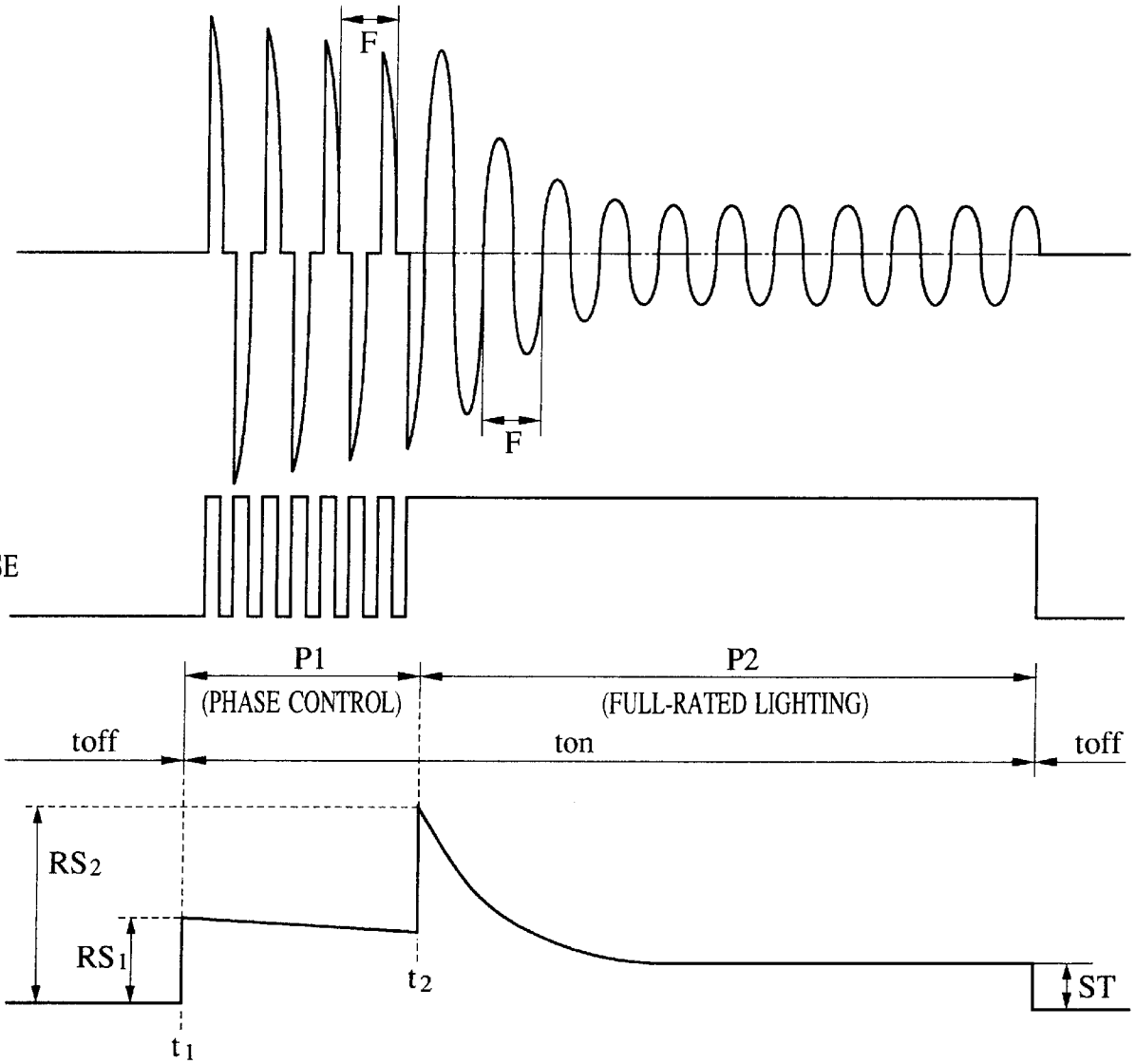
FIGS. 3A–3C are waveform diagrams showing waveforms of the circuit shown in FIG. 1.

FIGS. 3A–3C show waveform diagrams showing the relationship between the current flowing through the fixing heater 3 and the drive pulse from the selector 10.

FIG. 3A shows a waveform Lin1 of the current flowing through the fixing heater 3, wherein F represents one period of the alternating current utility power. FIG. 3B shows the drive pulse output by the selector 10, in which the switching element 4 is turned on during a high-level period (ton) and is turned off during a low-level period (toff). FIG. 3C shows the root-mean-square value Lin1rms into which the current waveform Lin1 is converted every half period of the alternating current utility power.

The fixing heater 3 is not powered, with no current supplied, during the toff period because the switching element 4 is continuously turned off. The fixing roller, housing the fixing heater 3, has a relatively larger thermal capacity, while the fixing heater 3 has a relatively smaller thermal capacity. The fixing roller slowly drops in its surface temperature, while the fixing heater 3 drops in temperature rapidly. For this reason, the fixing heater 3 gives off no heat and drops in temperature during the toff period, causing its resistance to become very low.

Figures 16A, 16B, 16C:
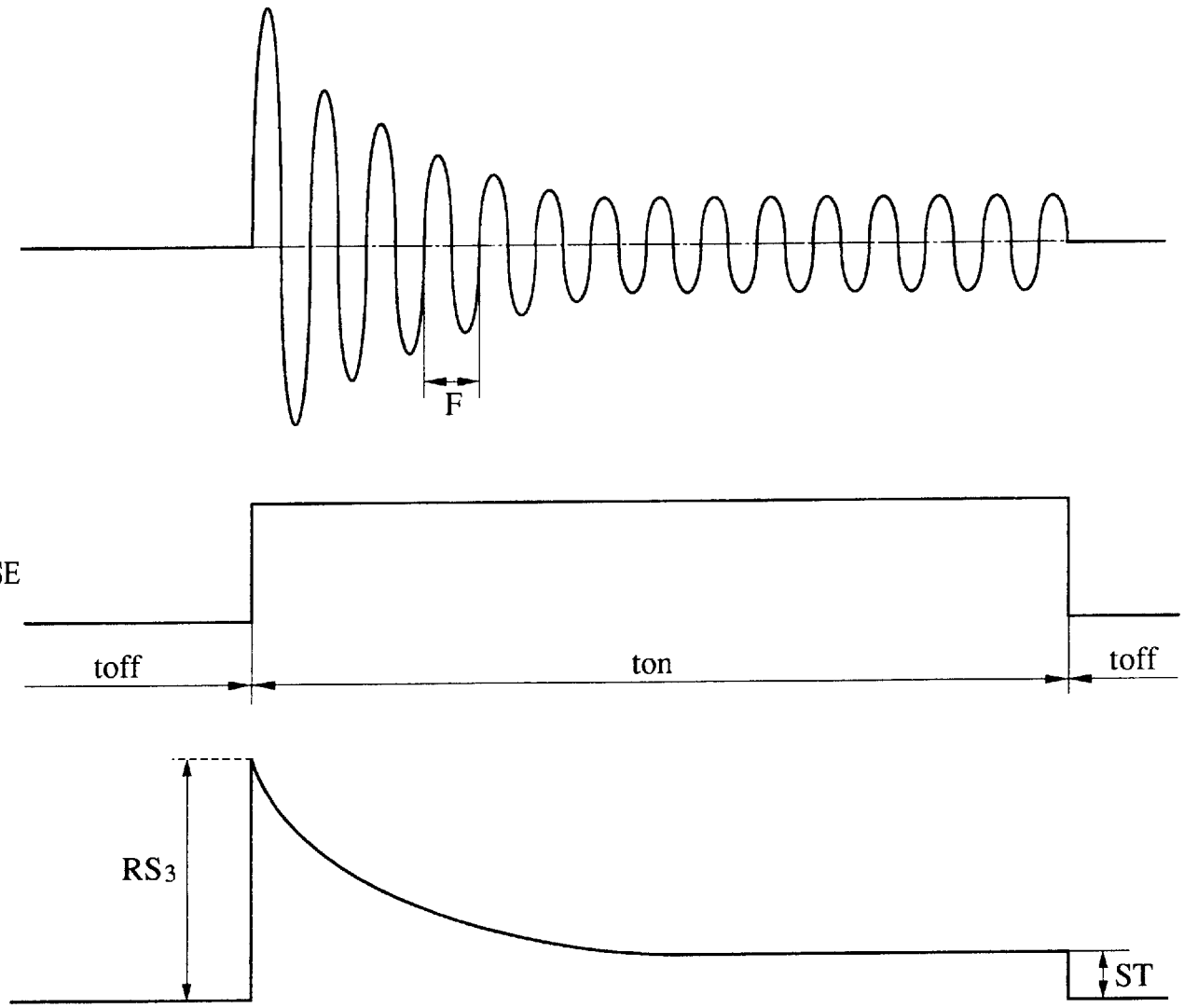
FIGS. 16A–16C are waveform diagrams of the circuit arrangement of FIG. 15.

With the surface temperature of the fixing roller lowered, the drive pulse (FIG. 3B) is transitioned to a high level from t, thereafter, and the alternating current Lin1 is fed to the fixing heater 3 starting the conductive state in the fixing heater 3. The drive pulse at this moment is the phase-control drive pulse for allowing the current to flow through the fixing heater 3 under phase control of a fixed conducting angle. Even if the current Lin1 is fed to the fixing heater 3 with an extremely low resistance, a root-mean-square value $RS_1$ into which a rush current flowing into the fixing heater 3 is converted every half the period of the alternating current utility power is a fraction of the rush current peak value $RS_3$ of the conventional art shown in FIG. 16 (the value of the fraction depending on the conducting angle of phase control).

The phase-control drive pulse is used to perform the phase control at the fixed conducting angle during the fixed duration P1. Meanwhile, the fixing heater 3 rises in temperature, gradually increasing its resistance. When the fixed duration P1 elapses, namely at $t_2$, the fixing heater 3 is supplied with the full-rated lighting drive pulse for full-rated lighting (continuous lighting) during P2. The root-mean-square value $RS_2$ into which a second rush current flowing into the fixing heater 3 at $t_2$ is converted every half the period of the alternating current utility power is smaller than the rush current peak value $RS_3$ of the conventional art shown in FIG. 16. The difference between the root-mean-square value $RS_2$ and the stationary root-mean-square value ST ($RS_2$–ST) is even smaller than ($RS_3$–ST) (FIG. 3C).

Each time the fixing heater 3 is transitioned from the non-conductive state to the conductive state in response to the heater on/off signal generated by the detected surface temperature of the fixing roller, the power supplied to the fixing heater 3 is restricted through the phase control of the fixed phase angle. The arrangement reduces the root-mean-square value of the rush current every half the period of the alternating current at the start of the conductive state.

The above arrangement prevents an instantaneous voltage drop in the power supply voltage of an image forming apparatus such as a printer or a copying machine having the heater device thus constructed, or an instantaneous voltage drop in the power supply voltage through the impedance of the interior wiring for feeding the alternating current utility power to the above heater device. The above arrangement also reduces the adverse effect from the instantaneous voltage drop on other apparatuses that share the same power supply line with the above apparatus in its vicinity. For example, a drop in illuminance, thus flickering of lighting equipment is reduced. The phase control with the fixed phase angle permits a simple circuit arrangement and a low noise feature, compared with the phase control with the phase angle gradually increasing.

Second embodiment

Figure 4:
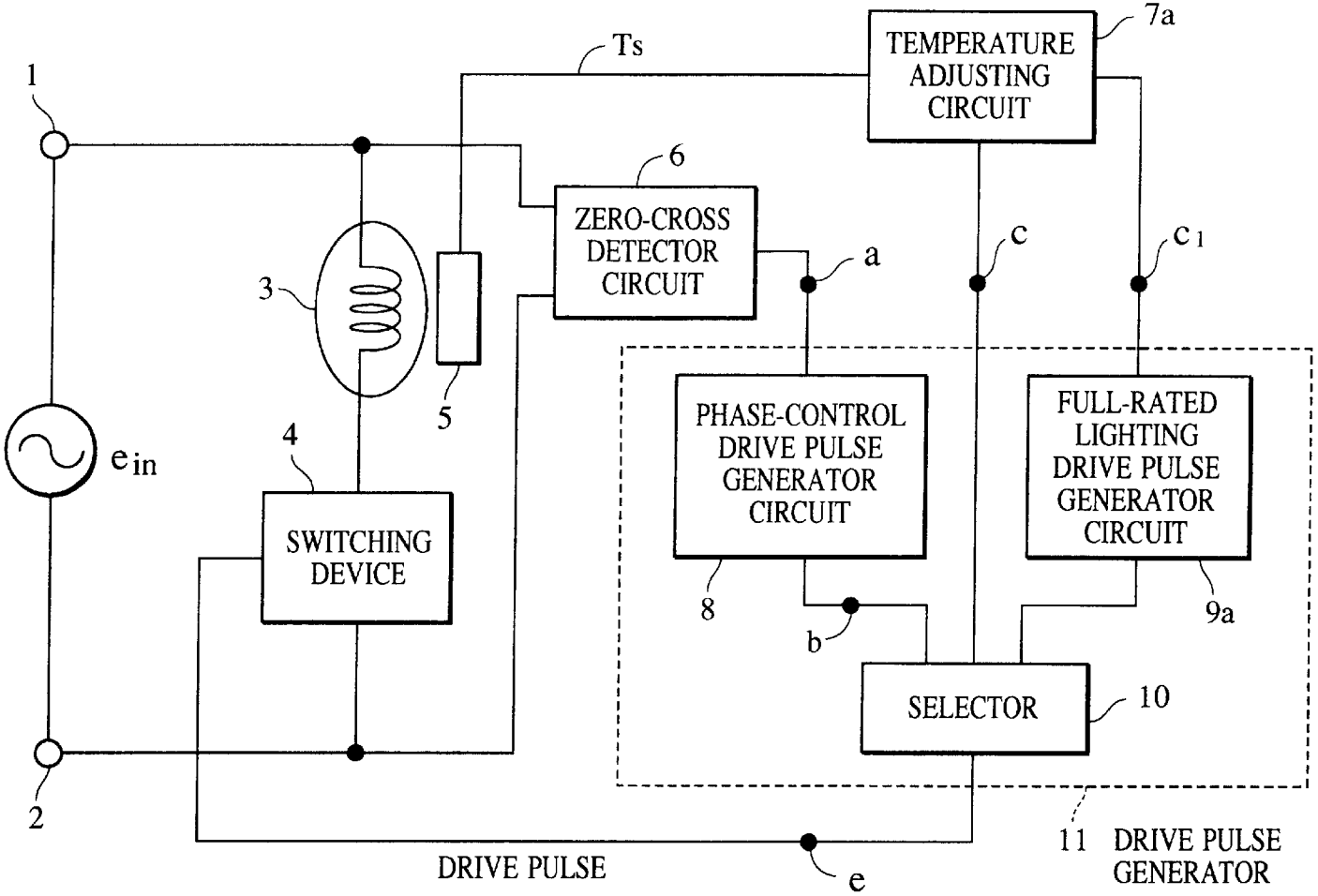
FIG. 4 is a block diagram showing a major portion of a second embodiment of image forming apparatus of the present invention.

FIG. 4 is a block diagram showing a major portion of a second embodiment of image forming apparatus of the present invention. In FIG. 4, components identical to those described with reference to FIG. 1 are designated with the same reference numerals.

The arrangement shown in FIG. 4 is different from that in FIG. 1 in that the duration of phase control is varied based on the surface temperature of the fixing roller detected by the temperature sensor 5. Specifically, a temperature adjusting circuit 7*a* and a full-rated lighting drive pulse generator circuit 9*a* constituting the drive pulse generator 11 are functionally different from their counterparts in the first embodiment.

Referring to timing diagrams in FIGS. 5A–5G showing signals of the circuit arrangement in FIG. 4, the difference is now discussed.

Figures 5A, 5B, 5C, 5D, 5E, 5F, 5G:
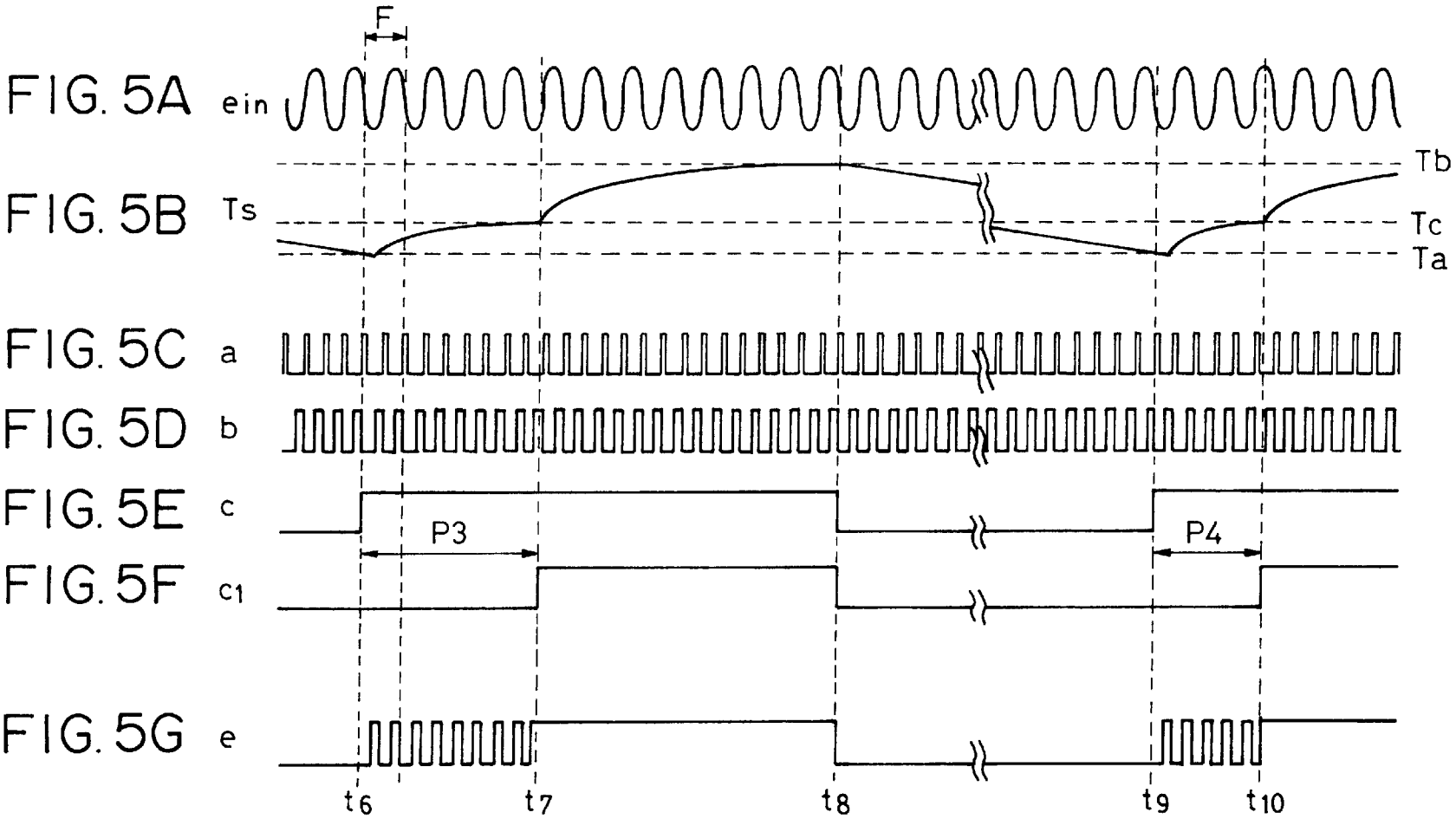
FIGS. 5A–5G are timing diagrams showing signals in the circuit arrangement shown in FIG. 4.

FIG. 5B showing a temperature Ts detected by a temperature sensor 5*a,* FIG. 5F showing the output of a temperature adjusting circuit 7*a* at a point c1, and FIG. 5G showing the output of the selector at a point e are different from the corresponding timing diagrams in FIGS. 2B, 2F and 2G, and the remaining diagrams are unchanged.

Referring to FIG. 5B, the temperature adjusting circuit 7*a* detects not only the upper limit Ta and lower limit Tb of temperature control range of the fixing roller but also a predetermined temperature Tc between the upper limit Ta and lower limit Tb.

The temperature sensor 5 detects the surface temperature of the fixing roller, and outputs the detected temperature signal Ts to the temperature adjusting circuit 7*a*. When the temperature adjusting circuit 7*a* senses at $t_6$ ($t_9$) that the surface temperature of the fixing roller drops to Ta, the temperature adjusting circuit 7*a* drives high the heater on/off signal output to the selector 10 (FIG. 5E).

When the heater on/off signal from the temperature adjusting circuit 7*a* rises to a high level, the selector 10 outputs to the switching element 4, as a drive pulse, a phase-control drive pulse (FIG. 5D) output by the phase-control drive pulse generator circuit 8. In this way the fixing heater 3 is powered through phase control.

When the temperature adjusting circuit 7*a* senses at $t_7$ ($t_{10}$) that the surface temperature of the fixing roller heated by the fixing heater 3 rises and reaches the predetermined temperature Tc, the temperature adjusting circuit 7*a* drives high the output at the point c1 (FIG. 5F) and outputs it to the full-rated lighting drive pulse generator circuit 9*a*. The full-rated lighting drive pulse generator circuit 9*a* outputs a full-rated lighting drive pulse in synchronization with the output of the temperature adjusting circuit 7*a*. Sensing that the pulse is transitioned to a high level, the selector 10 outputs the full-rated lighting drive pulse to the switching element 4 as a drive pulse. The fixing heater 3 is thus powered for full-rated lighting.

When the temperature adjusting circuit 7*a* senses at $t_8$ that the surface temperature Tb of the fixing roller rises and reaches Tb, the temperature adjusting circuit 7*a* drives low its outputs at the point c1 fed to the full-rated lighting drive pulse generator circuit 9*a* and drives low the heater on/off signal at the point c fed to the selector 10. The output of the selector 10 is thus driven low, turning off the switching element 4 and thereby cutting off the current supply to the fixing heater 3. The falling timings of the output at the point c1 and the heater on/off signal are synchronized with the zero crossing at $t_8$.

As described above, when the current supply to the fixing heater 3 is cut off causing the surface temperature of the fixing roller to drop to Ta, the phase-control drive pulse allows current supply to start through phase control with a fixed conducting angle. When the surface temperature of the fixing roller rises to Tc, the fixing heater 3 is continuously powered at a full-rated lighting condition (with a zero trigger phase angle). Current is supplied to the fixing heater 3 through the phase control with the fixed phase angle until the surface temperature of the fixing roller rises from Ta to Tc (corresponding to durations P3 and P4 in FIG. 5F). These durations are not constant because they are dependent on halogen heaters, the fixing roller and the ambient temperature. For example, P3 is different from P4.

Since the surface temperature of the fixing roller at the start of the full-rated lighting is the constant temperature Tc, the resistance of the fixing heater 3 is also constant at the same moment. A second rush current at the start of the full-rated lighting is therefore substantially constant, and there is no need for increasing the current rating of the switching element 4. Adjusting the temperature setting of Tc keeps substantially constant the power required at the moment the phase control is switched to the full-rated lighting. If Tc is set to an optimum temperature to prevent flickering, a drop in illuminance, namely flickering of the lighting equipment is effectively reduced. The adverse effect of the voltage drop onto other apparatuses that share the power line is also reduced.

Third embodiment

Figure 6:
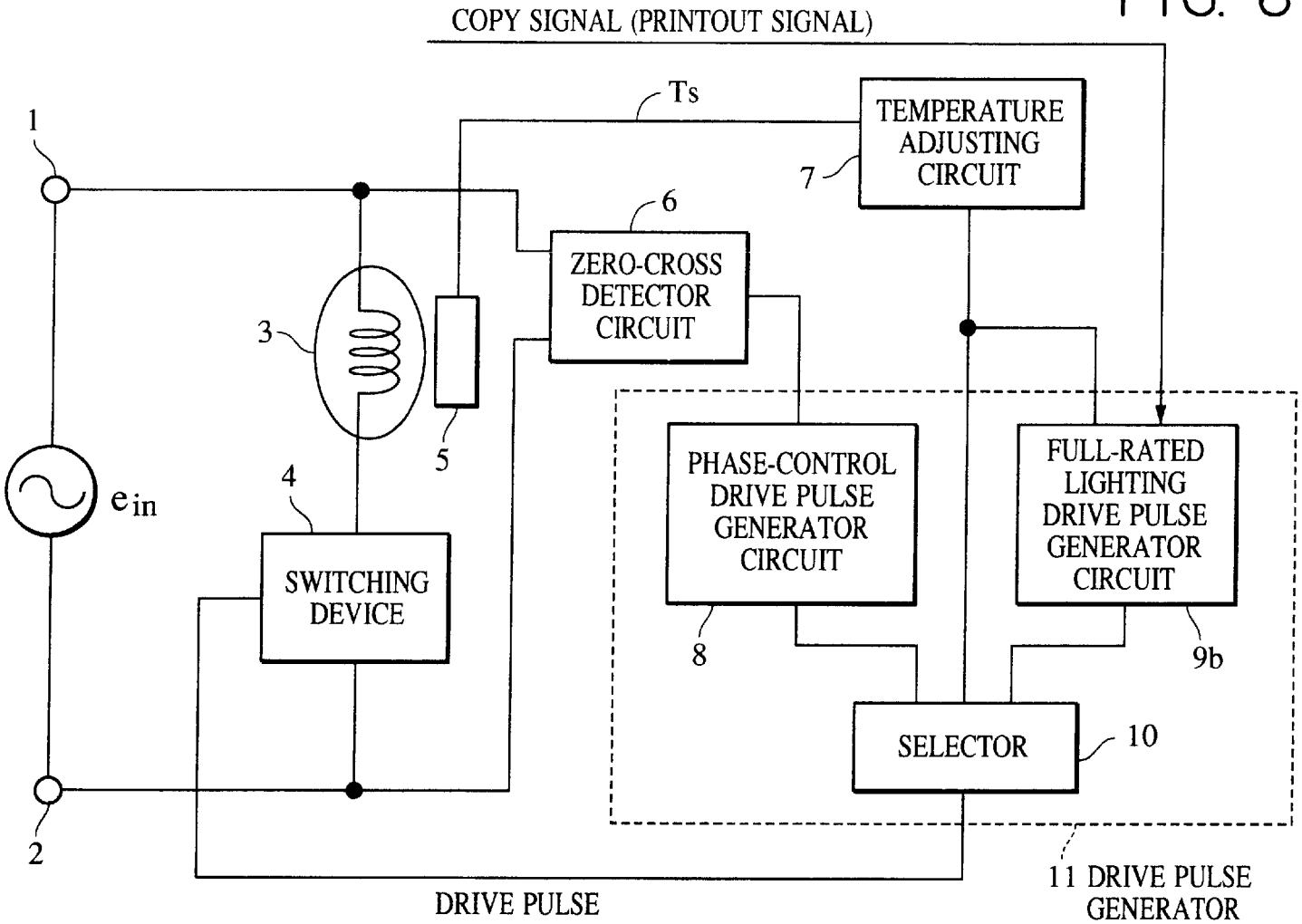
FIG. 6 is a block diagram showing a major portion of a third embodiment of image forming apparatus of the present invention.

FIG. 6 is a block diagram showing a major portion of a third embodiment of image forming apparatus of the present invention. As shown, components described with reference to FIG. 1 are designated with the same reference numerals.

The arrangement shown in FIG. 6 is different from that in FIG. 1 in that the duration of phase control is varied between an image forming operation of the image forming apparatus such as a copying machine or a printer (during a copying operation or a printing operation) and a standby period. Specifically, a full-rated lighting drive pulse generator circuit 9*b* receives an external copy signal or printout signal.

The operation of the circuit arrangement in FIG. 6 is different from that of the circuit in FIG. 1 only when the full-rated lighting drive pulse generator circuit 9*b* receives the copy signal or printout signal from an external control circuit, and the difference only is here discussed.

During an image forming operation, a recording paper captures heat from the fixing roller when the recording paper passes through the fixing unit. The fixing roller therefore emits more heat than during the standby period. The rate of temperature drop is accordingly faster. The high-level duration of the drive pulse for making the switching element to switch becomes longer than that during the standby period while the low-level duration of the drive pulse becomes shorter. The resistance of the fixing heater 3 at the moment the switching element 4 is transitioned from off to on is higher than that during the standby period.

An efficient heat transfer to the fixing roller is needed during the image forming operation, and the duration of phase control is preferably as short as possible as long as the flickering is reduced. A determination is made of whether the full-rated lighting drive pulse generator circuit 9*b* receives a copy signal and a printout signal from the external control circuit. More specifically, the full-rated lighting drive pulse generator circuit 9*b* determines whether the image forming operation is in progress. The phase control duration (the duration P1 in FIGS. 2 and 3) is made shorter during the image forming operation with a larger heat emission than during the standby period with a smaller heat emission.

In this embodiment, control of the current supply to the fixing heater is made different between during the image forming operation for copying or printing and during the standby period. Heat is thus efficiently supplied to the fixing roller, and the adverse effect such as the flickering on other apparatuses is reduced in the same way as the preceding embodiments.

Fourth embodiment

Figure 7:
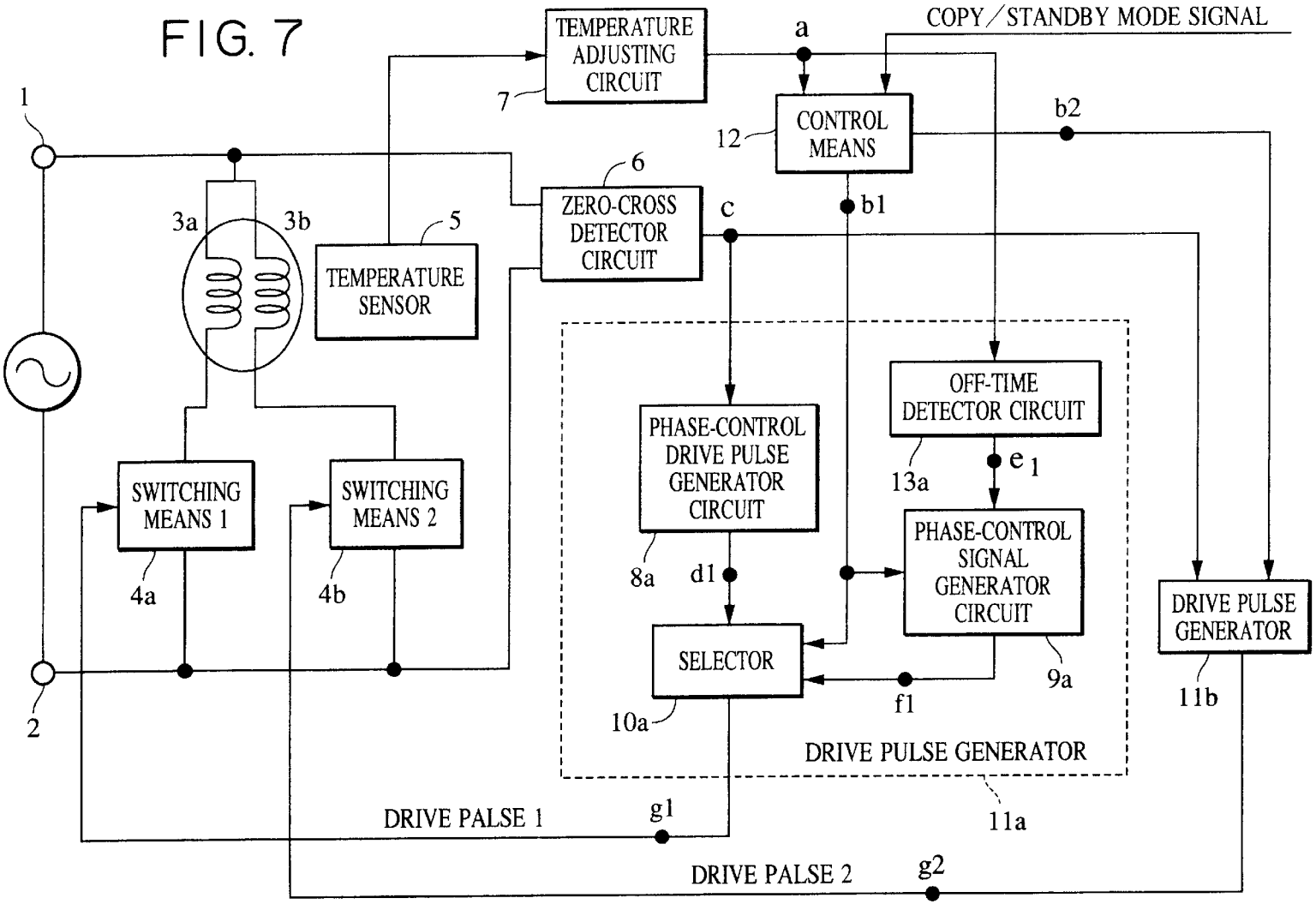
FIG. 7 is a block diagram showing a major portion of a fourth embodiment of image forming apparatus of the present invention.

FIG. 7 is a block diagram showing a major portion of a fourth embodiment of image forming apparatus of the present invention. The fourth embodiment comprises two heaters in its fixing unit.

Referring to FIG. 7, an alternating current power is supplied across input terminals 1 and 2 connected to an alternating current utility power line. Connected between the input terminals 1 and 2 is a series network, consisting of heaters 3*a* and 3*b* and alternating current switching means 4*a* and 4*b*, to which the alternating current utility power is supplied. The heaters 3*a* and 3*b* are housed in an unshown fixing roller and is extended in the axial direction of the fixing roller. A halogen lamp with a power rating of several hundred W to 1 kW and with a resistance of a positive temperature coefficient is typically used for the heaters.

The two heaters 3*a* and 3*b* arranged in the axial direction of the fixing roller as shown in FIG. 7 are intended to uniformly heat the entire roller so that copy papers of a wide range of size are handled. The heaters 3*a* and 3*b* are designed to have different light emission alignments.

The alternating current switching means 4*a* and 4*b* is an alternating current switch that conducts an alternating current utility power at any timing.

The fixing roller fixes a toner image transferred onto a recording medium onto the recording medium.

A temperature sensor 5 is arranged in the close vicinity of the surface of the fixing roller, and is typically a thermistor with an impedance having a known temperature coefficient. This arrangement allows the temperature of the surface of the fixing roller to be constantly detected, and a detected temperature signal is output to a temperature adjusting circuit 7.

The temperature adjusting circuit 7 controls the switching means 4*a* and 4*b* for switching in response to the detected temperature signal, thereby controlling the on/off timings of the heaters 3*a* and 3*b*. To this end, the temperature adjusting circuit 7 outputs a heater on/off signal a.

Specifically, the temperature adjusting circuit 7 outputs an off signal when the surface temperature of the fixing roller rises and reaches the upper limit of a temperature control range, and outputs an on signal when the surface temperature of the fixing roller drops and reaches the lower limit of the temperature control range in succession to the off state.

Control means 12 stores a plurality of heater conduction control programs. Based on the heater on/off signals from the temperature adjusting circuit 7 and the external copy/standby mode signal, the control means 12 determines whether the apparatus is in the standby mode or copy/printing mode, and determines the size of the recording paper when the apparatus is in the copy/printing mode. The control means 12 then outputs on and off signals b1 and b2 to a selector 10*a* and a drive pulse generator 11*b* respectively to control the conduction of the heaters 3*a* and 3*b* in an optimum manner.

A zero crossing detector circuit 6, connected across the series circuit, detects the zero crossings of the alternating current utility power supplied to the series circuit across the input terminals 1 and 2.

In response to the output signal c of the zero crossing detector circuit 6, a phase-control drive pulse generator circuit 8*a* generates a drive pulse d1 for phase control and outputs it to the selector 10*a* as a phase-control drive pulse.

An off-time detector circuit 13*a* monitors the off time of the heater on/off signal a output by the temperature adjusting circuit 7, and outputs a high-level signal e1 to the full-rated lighting drive pulse generator circuit 9*a* when the off time of the heater on/off signal a exceeds a predetermined time. The full-rated lighting drive pulse generator circuit 9*a* outputs to the selector 10*a* a phase-control signal f1 having a predetermined duration of high level (duration of phase control) when the output of the control means 12 is transitioned to a high level with the output of the off-time detector circuit 13*a* at a high level.

The selector 10*a* receives the output signals from the phase-control drive pulse generator circuit 8*a,* the control means 12, and the full-rated lighting drive pulse generator circuit 9*a,* and outputs a drive pulse 1 (g1) for controlling the switching means 4*a* for switching depending on the level of each signal.

A drive pulse generator 11*b* receives the signal from the control means 12 and the output from the zero crossing detector circuit 6, and outputs a drive pulse 2 (g2) for controlling the switching means 4*b* for switching depending on the level of each input signal to the drive pulse generator 11*b*.

The operation of the circuit arrangement in FIG. 7 is now discussed referring to waveform diagrams shown in FIGS. 8A–8E and timing diagrams shown in FIGS. 9A–9I.

When the alternating current utility power (FIG. 8A) is supplied across the input terminals 1 and 2, an unshown power supply circuit rectifies it to a direct current power to energize the above-described circuits 5, 6, 7, 8*a,* 9*a,* 10*a,* 11*a,* 11*b,* 12, and 13*a*.

Figures 8A, 8B, 8C, 8D, 8E:
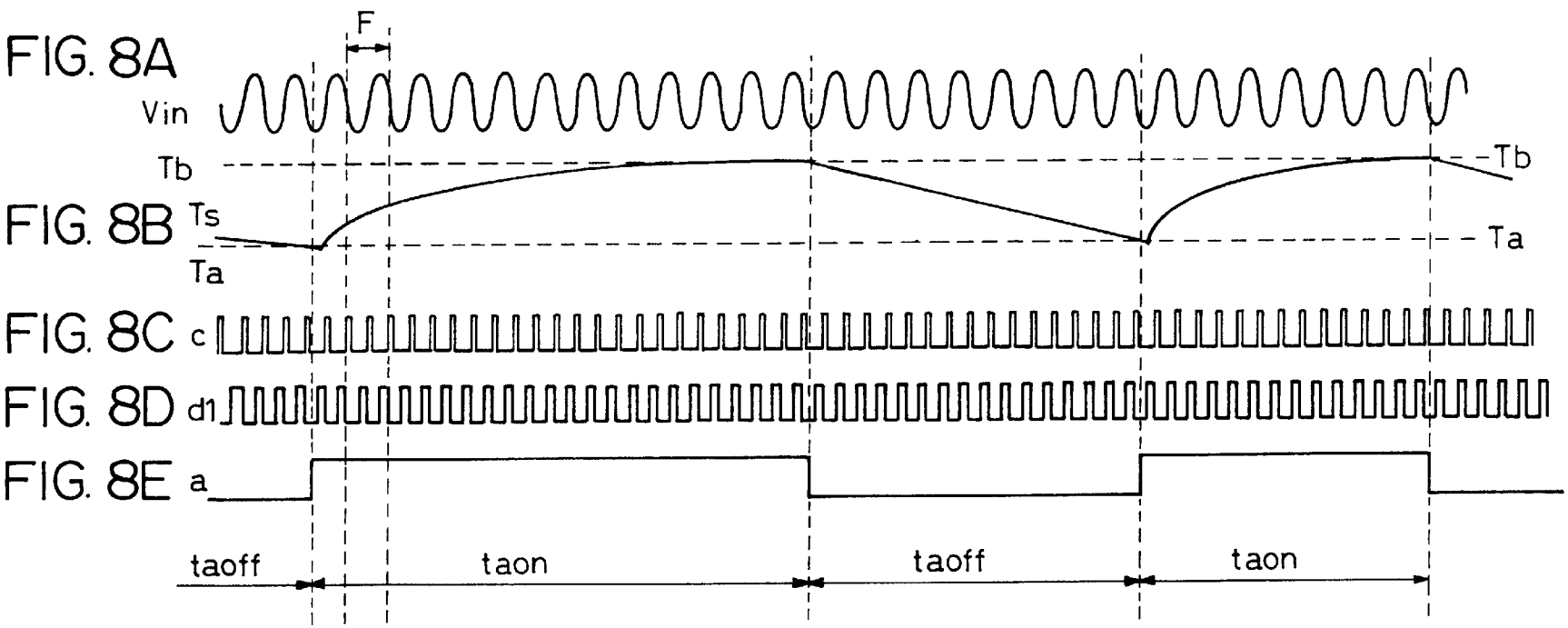
FIGS. 8A–8E are waveform diagrams of the circuit arrangement shown in FIG. 7.

The temperature sensor 5 detects the surface temperature of the fixing roller and outputs the detected temperature signal (FIG. 8B) to the temperature adjusting circuit 7. The temperature adjusting circuit 7 outputs the on signal to the control means 12 and the off-time detector circuit 13*a* when the detected surface temperature of the fixing roller drops by 1° C. below the lower limit Ta of the predetermined temperature control range and outputs the off signal to the control means 12 when the surface temperature of the fixing roller rises and reaches the upper limit Tb of the predetermined temperature control range (FIG. 8E and FIG. 9A).

The off-time detector circuit 13*a* outputs a low-level signal to the full-rated lighting drive pulse generator circuit 9*a* (FIG. 9F) when the heater on/off signal (FIG. 8E and FIG. 9A) from the temperature adjusting circuit 7 is on (at a high level), and outputs a high-level signal to the full-rated lighting drive pulse generator circuit 9*a* (FIG. 9F) when a predetermined time (Pe2) elapses from the transition of the heater on/off signal (FIG. 8E and FIG. 9A) from on to off (at a low level). The off-time detector circuit 13*a* outputs a low-level signal to the full-rated lighting drive pulse generator circuit 9*a* (FIG. 9F) when a predetermined time (Pe1) elapses from the transition of the heater on/off signal (FIG. 8E and FIG. 9A) from off to on.

Based on the heater on/off signal (FIG. 8E and FIG. 9A) from the temperature adjusting circuit 7 and the external copy/standby mode signal, the control means 12 selects the optimum heater conduction control appropriate for the current state of a copying machine or printer, and then outputs the on/off signals to the selector 10 (FIG. 9B) and the drive pulse generator 11*b* (FIG. 9C), respectively, for conduction control of the heaters 3*a* and 3*b*. FIGS. 9B and 9C show examples of timing diagrams, wherein ton1 and ton2 are fixed values.

Figures 9A, 9B, 9C, 9D, 9E, 9F, 9G, 9H, 9I:
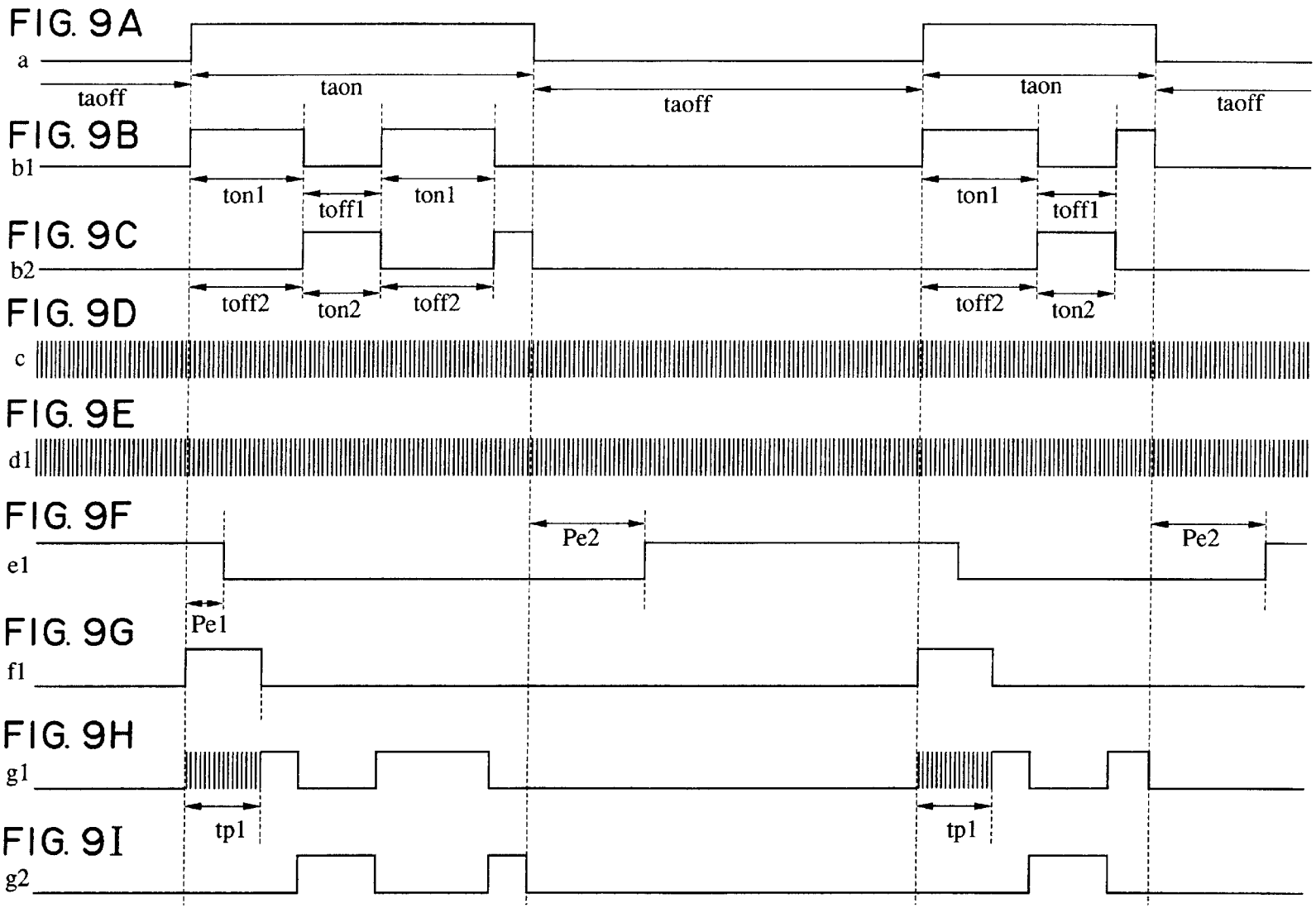
FIGS. 9A–9I are timing diagrams showing signals of the circuit arrangement shown in FIG. 7.

In the examples of FIGS. 9B and 9C, when the heater on/off signal (FIG. 9A) output by the temperature adjusting circuit 7 is transitioned from a low level to a high level, the heater 3*a* is first turned on for a fixed duration ton1 (with the heater 3*b* off). When the heater 3*a* is turned off, the heater 3*b* is then turned on for a fixed duration ton2 (with the heater 3*a* off). When the heater 3*b* is then turned off, the heater 3*a* is turned on again for a fixed duration ton1 (with the heater 3*b* off). The heaters 3*a* and 3*b* are thus alternatingly turned on. When the heater on/off signal (FIG. 9A) is transitioned from a high level to a low level, both heaters 3*a* and 3*b* are turned off. Both heaters 3*a* and 3*b* remain off until the heater on/off signal (FIG. 9A) is driven high.

When the on/off signal (FIG. 9B) is transitioned from a low level to a high level with the signal (FIG. 9F) from the off-time detector circuit being high, the full-rated lighting drive pulse generator circuit 9*a* generates a phase-control signal (FIG. 9G) which rises to a high level in synchronization of the on/off signal and then falls to a low level after remaining high for a predetermined duration (tp1, a duration of phase control). The full-rated lighting drive pulse generator circuit 9*a* outputs the phase-control signal to the selector 10*a* (FIG. 9G).

The zero crossing detector circuit 6 continuously monitors the alternating current utility power for the zero crossing, and outputs the zero crossing signal (FIG. 8C and FIG. 9D) to the phase-control drive pulse generator circuit 8*a* and the drive pulse generator 11*a*.

Receiving the zero crossing signal (FIG. 8C and FIG. 9D), the phase-control drive pulse generator circuit 8*a* outputs to the selector 10*a* as a drive pulse the phase-control drive pulse at the fixed phase angle (FIG. 8D and FIG. 9E) for switching on and off the switching means 4*a* so that power supply to the heaters is restricted every half cycle of alternating current utility power.

The selector 10*a* receives the phase-control drive pulse (FIG. 9E) from the phase-control drive pulse generator circuit 8*a,* the on/off drive pulse (FIG. 9B) from the control means 12, and the phase-control signal (FIG. 9G) from the full-rated lighting drive pulse generator circuit 9*a*. When the on/off drive pulse (FIG. 9B) remains low, the selector 10*a* drives low the output drive pulse 1. When both the on/off drive pulse (FIG. 9B) and the phase-control signal (FIG. 9G) remain high, the selector 10*a* outputs the phase-control drive pulse (FIG. 9E) as the drive pulse 1 to the switching means 4*a*. When the on/off drive pulse (FIG. 9B) is high with the phase-control signal (FIG. 9G) at a low level, the selector 10*a* outputs the on/off drive pulse (FIG. 9B) as the drive pulse 1 to the switching element 4*a*. The switching element 4*a* is controlled in this way.

In response to the on/off signal (FIG. 9C) from the control means 12, the drive pulse generator 11*b* generates a drive pulse (FIG. 9I) in synchronization with the zero crossing signal (FIG. 9D) output by the zero crossing detector circuit 6. The drive pulse generator 11*b* outputs the drive pulse to the switching means 4*b* to turn it on and off.

In this way the switching operation of the switching means 4*a* and 4*b* controls the timing of current supplying to the heaters 3*a* and 3*b*.

If the non-conduction time of the heater 3*a* is longer than the predetermined time (Pe2 in FIG. 9F) prior to the start of current supplying, a current controlled by a fixed conducting angle is conducted for a predetermined duration (tp in FIG. 9H). If the non-conduction time of the heater 3*a* is shorter than the predetermined time (Pe2 in FIG. 9F), a current is allowed to flow in synchronization with the zero crossing of the alternating current utility power. The surface temperature of the fixing roller is controlled to within a predetermined control range.

Figures 10A, 10B, 10C, 10D, 10E, 10F:
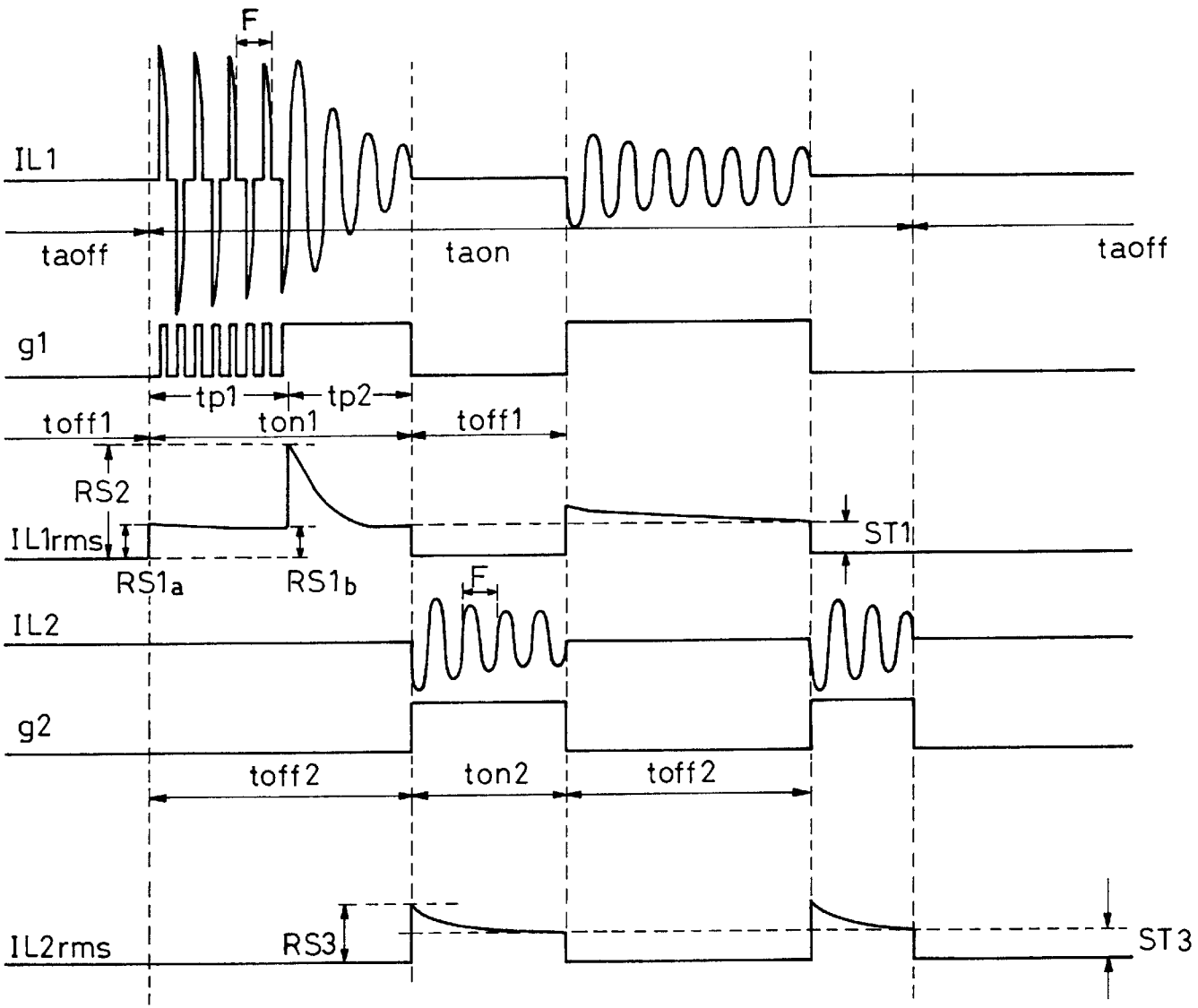
FIGS. 10A–10F are waveform diagrams of the circuit arrangement shown in FIG. 7.

FIGS. 10A–10F are waveform diagrams showing the relationship between currents flowing through the heaters 3*a* and 3*b* and the drive pulses g1 and g2. FIG. 10A shows a waveform of the current flowing through the heater 3*a,* wherein F represents one period of the alternating current utility power.

FIG. 10B shows the drive pulse 1 (g1). Power to the heater 3*a* is restricted for the duration of tp1 of a high-level period (ton1), during which a fixed phase-angle phase control is performed. Power is not restricted for the duration of tp2, during which a sinusoidal current flows into the heater 3*a*. During a low-level period (toff1), the switching means 4*a* remains off, allowing no current to flow through the heater 3*a*. FIG. 10C shows a root-mean-square value IL1rms into which the current waveform IL1 is converted every half period of the utility power frequency.

FIG. 10D shows a current waveform IL2 flowing into the heater 3*b,* wherein F represents one period of the alternating current utility power. FIG. 10E shows the drive pulse 2 (g2). During a high-level period (ton2), the switching means 4*b* is turned on, and during a low-level period (toff2), the switching means 4*a* is turned off. FIG. 10F shows a root-mean-square value IL2rms into which the current waveform IL2 is converted every half period of the utility power frequency.

The heaters 3*a* and 3*b* are not powered during the taoff period in FIG. 9A because both switching means 4*a* and 4*b* are turned off. The heaters 3*a* and 3*b* are arranged within the fixing roller. The fixing roller has a larger thermal capacity while the heaters 3*a* and 3*b* have a smaller thermal capacity. The temperature drop rate of the fixing roller is therefore slow while the heater 3*a* rapidly drops in temperature. The heaters 3*a* and 3*b* generate no heat during the taoff period, rapidly dropping in temperature and resulting in an extremely low resistance.

The output of the temperature adjusting circuit 7 is transitioned to a high level with the surface temperature of the fixing roller lowered. The drive pulse 1 (g1) rises to a high level, causing the heater 3*a* to be supplied with the alternating current utility power. This process permits the utility power to be fed to an extremely low resistance. The drive pulse 1 (g1) is the phase-control drive pulse for the fixed phase-angle control in which the current flowing through the heater 3*a* is restricted. Even if the extremely low resistance heater 3*a* is supplied with the current IL1, the root-mean-square value RS1*a* into which a rush current flowing into the heater 3*a* is converted every half period of the utility power frequency falls within a fraction (dependent on the conducting angle of phase control) of a root-mean-square value RS3 of a rush current in the conventional art.

The phase control is performed by the phase-control drive pulse for the fixed duration tp1, during which the heater 3*a* gradually rises in temperature increasing its resistance. Even if the heater 3*a* is supplied with the full-rated lighting power (for continuous lighting) for tp2 subsequent to the elapse of fixed duration tp1, a root-mean-square value RS2 into which a second rush current is converted every half period of the utility power frequency is smaller than the root-mean-square value RS3 in the conventional art. The change between the root-mean-square values at the start of the full-rated lighting (RS2–RS1*b*) is smaller than the change in the root-mean-square value RS3 of the rush current in the conventional art.

The heaters 3*a* and 3*b* are alternatingly turned on. For example, the heater 3*b,* when turned on, is already heated by the heater 3*a*. At the moment the heater 3*b* is turned on, a rush current not so large, even compared with a stationary state current ST, flows through the heater 3*b*. When the heater 3*b* is turned off and the heater 3*a* turned on, the rush current into the heater 3*a* is small because the heater 3*a* is already heated.

Power restricted through phase control is allowed to flow through the heater 3*a* for the predetermined duration only subsequent to the switching from taoff to taon. Even if the heater 3*a* is thereafter turned on and off, no phase control is repeated in the heater 3*a* in the same taon period. No phase control is performed at all in the heater 3*b* in any on period.

When the heater on/off signal generated in response to the surface temperature of the fixing roller switches the heater 3*a* to its conduction state from non-conduction state in succession to the off period longer than the predetermined time, power supplied to the heater 3*a* is restricted through phase control for the predetermined duration. With this arrangement, the change in the root-mean-square value of the rush current of the utility power every half period of the utility power frequency is reduced.

The above arrangement prevents an instantaneous voltage drop in the power supply voltage of an image forming apparatus, such as a printer or a copying machine having the heater device thus constructed, or an instantaneous voltage drop in the power supply voltage through the impedance of the interior wiring for feeding the alternating current utility power to the above heater device. The above arrangement also reduces the adverse effect from the instantaneous voltage drop on other apparatuses that share the power supply line with the above apparatus in its vicinity. For example, a drop in illuminance, thus flickering of lighting equipment is reduced.

According to the present invention, the off-time detector circuit 13*a* detects the off time of the heater on/off signal output by the temperature adjusting circuit 7. Alternatively, the off time of the drive pulse 1 output by the selector 10*a* may be equally used.

In the above description of the present invention, the switching means 4*a* is necessarily first turned on to power the heater 3*a* when the heater on/off signal output by the temperature adjusting circuit 7 is transitioned from a low level (off) to a high level (on). At the transition of the heater on/off signal from a low level to a high level, the control may fail to determine which of the switching means 4*a* and 4*b* is first turned on or the control may permit both switching means 4*a* and 4*b* to be concurrently turned on. Even in such a case, the drive pulse generator 11*b* shown in FIG. 7 may have the same construction as the drive pulse generator 11*a* so that power to both heaters 3*a* and 3*b* is restricted for the predetermined duration at the heater power on. Specifically, the drive pulse generator 11*b* may be constructed of the phase-control drive pulse generator circuit 8*a,* full-rated lighting drive pulse generator circuit 9*a,* selector 10*a,* and off-time detector circuit 13*a*.

Fifth embodiment

Figure 11:
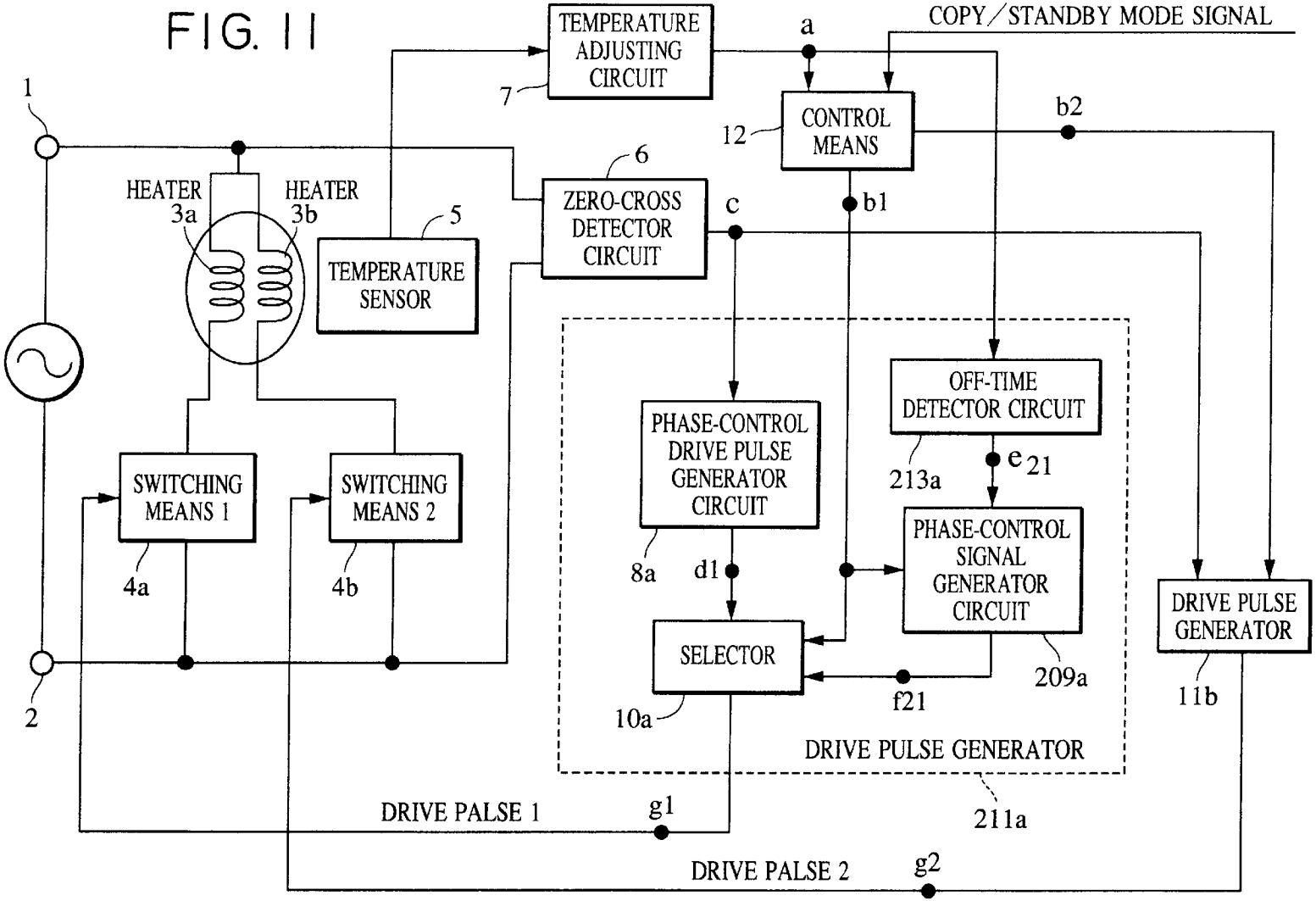
FIG. 11 is a block diagram showing a major portion of a fifth embodiment of image forming apparatus of the present invention.

Referring now to FIG. 11, a fifth embodiment of the present invention is discussed. FIG. 11 is a block diagram showing the construction of a heater control circuit of the fifth embodiment of the present invention. As shown, components identical to those described with reference to FIG. 7 are designated with the same reference numerals.

The phase control is performed for the fixed duration tp1 in FIG. 7, while the fifth embodiment shown in FIG. 11 varies the pulse width of the output of a phase-control signal generator circuit 209*a* which determines the duration of phase control depending on the off period of the heater on/off signal.

Referring to timing diagrams shown in FIGS. 12A–12I, the operation of the fifth embodiment shown in FIG. 11 is discussed.

Figures 12A, 12B, 12C, 12D, 12E, 12F, 12G, 12H, 12I:
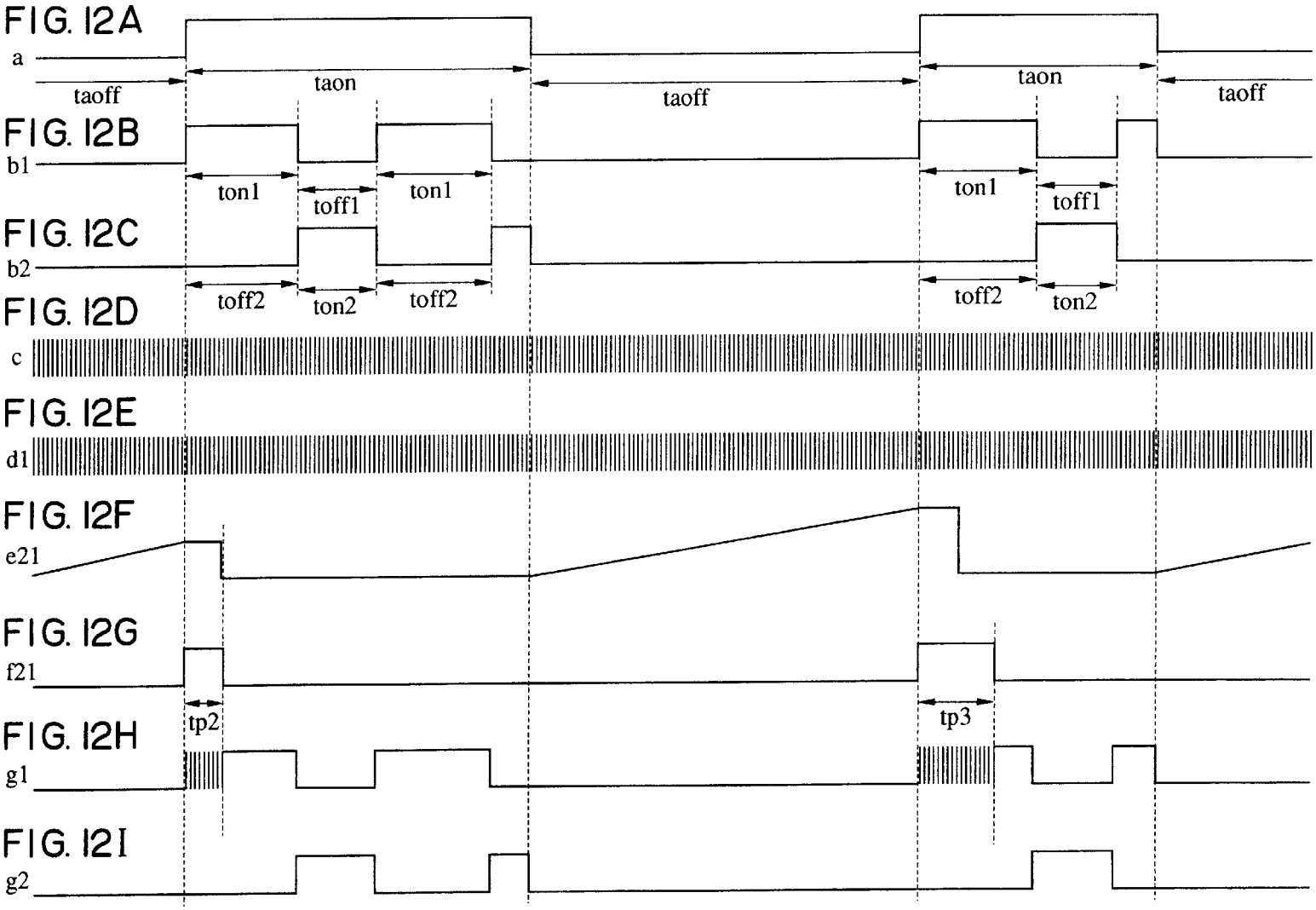
FIGS. 12A–12I are timing diagrams showing signals of the circuit arrangement shown in FIG. 11.

In an off-time detector circuit 213*a* in FIG. 11, the counting of the off time of the heater on/off signal starts at the moment the heater on/off signal output by the temperature adjusting circuit 7 is transitioned to off. The off-time detector circuit 213*a* outputs to the phase-control signal generator circuit 209*a* a voltage level that is proportional to the off time of the heater on/off signal as shown in FIG. 12F. The phase-control signal generator circuit 209*a* varies tp2 and tp3 of the output pulse shown in FIG. 12G in response to the output level of the off-time detector circuit 213*a* at the moment the heater on/off signal output by the temperature adjusting circuit 7 is transitioned from off to on. When the off time of the heater on/off signal is shorter, the duration of phase control is accordingly made shorter. When the off time of the heater on/off signal is longer, the duration of the phase control is made longer. Power supplying to the heaters is thus efficiently performed while controlling the flickering.

According to the present invention, the off-time detector circuit 213*a* detects the off time of the heater on/off signal output by the temperature adjusting circuit 7. Alternatively, the off time of the drive pulse 1 output by the selector 10*a* may be equally used.

In the above description of the present invention, the switching means 4*a* is necessarily first turned on to power the heater 3*a* when the heater on/off signal output by the temperature adjusting circuit 7 is transitioned from a low level (off) to a high level (on). At the transition of the heater on/off signal from a low level to a high level, the control may fail to determine which of the switching means 4*a* and 4*b* is first turned on or the control may permit both switching means 4*a* and 4*b* to be concurrently turned on. Even in such a case, the drive pulse generator lib shown in FIG. 11 may have the same construction as the drive pulse generator 11*a* so that power to both heaters 3*a* and 3*b* is restricted for the predetermined duration at the heater power on. Specifically, the drive pulse generator 11*b* may be constructed of the phase-control drive pulse generator circuit 8*a,* full-rated lighting drive pulse generator circuit 209*a,* selector 10*a,* and off-time detector circuit 213*a.*

Sixth embodiment

Figure 13:
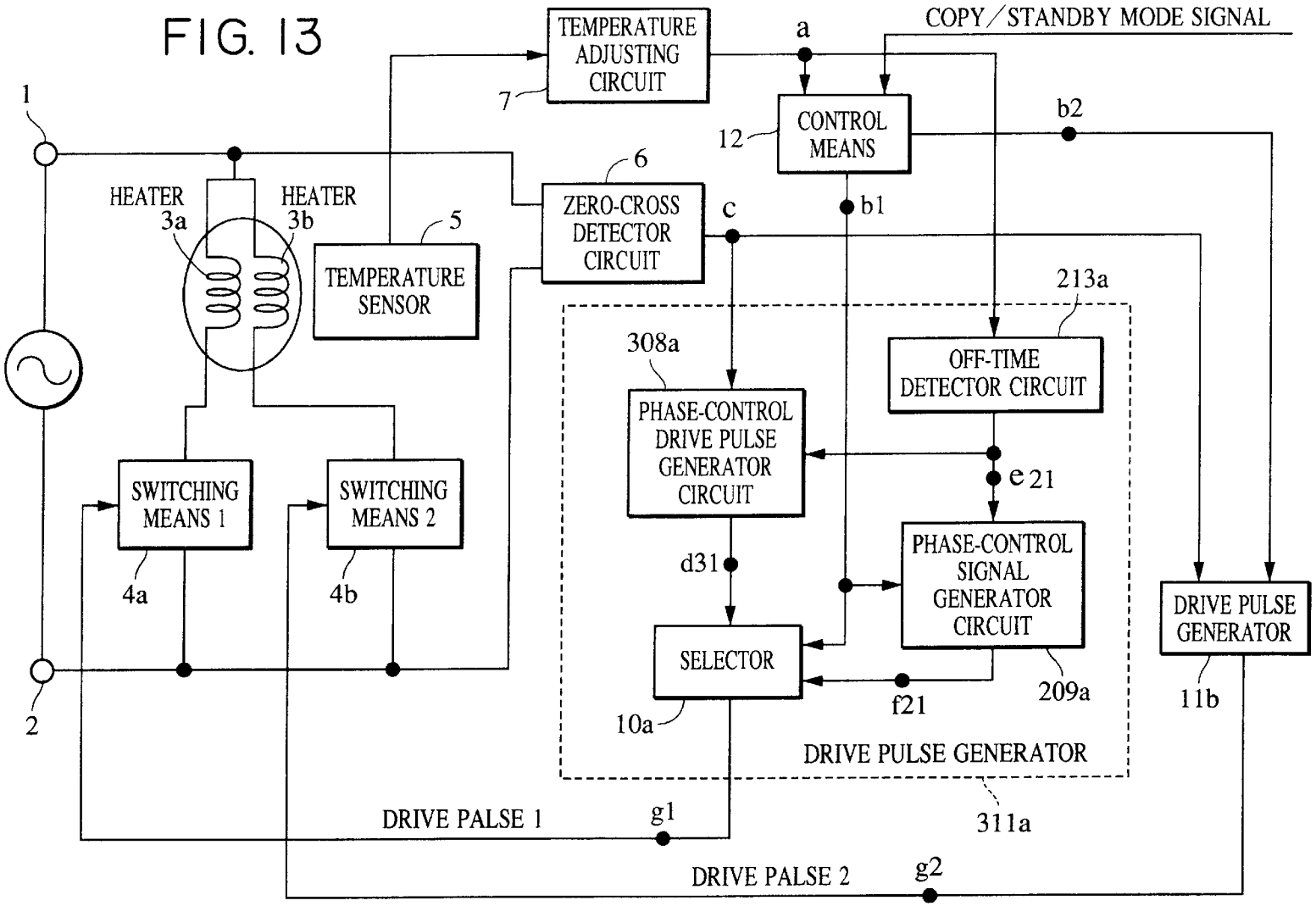
FIG. 13 is a block diagram showing a major portion of a sixth embodiment of image forming apparatus of the present invention.

Referring now to FIG. 13, a sixth embodiment of the present invention is discussed. FIG. 13 is a block diagram showing the construction of a heater control circuit of the sixth embodiment of the present invention. As shown, components identical to those described with reference to FIGS. 7 and 11 are designated with the same reference numerals.

The phase control is performed for the fixed duration tp1 throughout the duration of phase control in FIG. 7, while the sixth embodiment shown in FIG. 13 varies the pulse width of the output of a phase-control signal generator circuit 209*a* and the pulse width of the output of a phase-control drive pulse generator circuit 308*a,* depending on the off time of the heater on/off signal.

Referring to FIG. 13, the off-time detector circuit 213*a* and phase-control signal generator circuit 209*a* operate in the same manner as in FIGS. 11 and 12. The off-time detector circuit 213*a* outputs to a phase-control signal generator circuit 308*a* a voltage level that is proportional to the off time of the heater on/off signal. The phase-control signal generator circuit 308*a* adjusts the conducting angle of phase control depending on the output level of the off-time detector circuit 213*a* (namely, depending on the off time of the heater on/off signal). Specifically, the longer the off time, the phase-control signal generator circuit 308*a* makes the conducting angle of phase control narrower, and the shorter the off time, the phase-control signal generator circuit 308*a* makes the conducting angle of phase control wider.

When the off time is long, the resistance values of the heaters 3*a* and 3*b* greatly drop. The conducting angle is made narrow in a subsequent on period to reduce a change in the root-mean-square value of the current flowing through the heater 4*a* every half period of the utility power frequency. Furthermore, the duration of phase control is lengthened to reduce a change in a root-mean-square value of a second rush current at the transition from the phase control to the full-rated lighting every half period of the utility power frequency. The flickering is thus controlled.

When the off time is short, the resistance values of the heaters 3*a* and 3*b* do not drop much. Even if the conducting angle is widened in a subsequent on period, the change in the root-mean-square value of the current flowing through the heater 4*a* every half period of the utility power will not increase so much. Even if the duration of phase control is shortened, the change in a root-mean-square value of the second rush current at the transition from the phase control to the full-rated lighting every half period of the utility power frequency will not increase so much, and thermal energy is supplied to the fixing roller for a short period of time. In other words, the fixing roller is efficiently provided with thermal energy while the flickering is controlled.

According to the present invention, the off-time detector circuit 213*a* detects the off time of the heater on/off signal output by the temperature adjusting circuit 7. Alternatively, the off time of the drive pulse 1 output by the selector 10*a* may be equally used. The conducting angle during the phase control duration and the phase control duration are concurrently varied. Alternatively, the conducting angle only may be varied.

In the above description of the present invention, the switching means 4*a* is necessarily first turned on to power the heater 3*a* when the heater on/off signal output by the temperature adjusting circuit 7 is transitioned from a low level (off) to a high level (on). At the transition of the heater on/off signal from a low level to a high level, the control may fail to determine which of the switching means 4*a* and 4*b* is first turned on or the control may permit both switching means 4*a* and 4*b* to be concurrently turned on. Even in such a case, the drive pulse generator 11*b* shown in FIG. 13 may have the same construction as the drive pulse generator 11*a* so that power to both heaters 3*a* and 3*b* is restricted for the predetermined duration at the heater power on. Specifically, the drive pulse generator 11*b* may be constructed of the phase-control drive pulse generator circuit 308*a,* full-rated lighting drive pulse generator circuit 209*a,* selector 10*a,* and off-time detector circuit 213*a.*

Seventh embodiment

Figure 14:
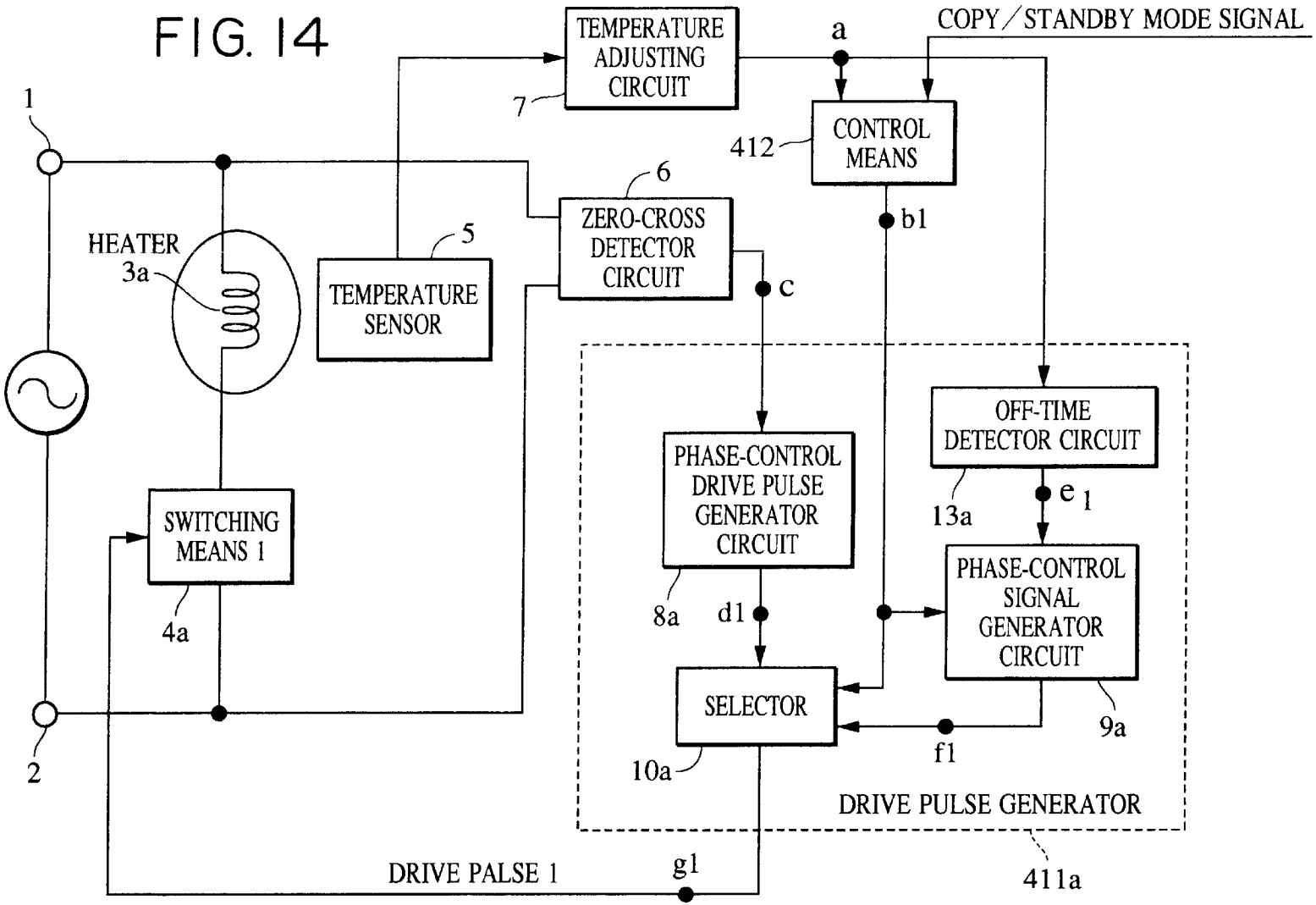
FIG. 14 is a block diagram showing a major portion of a seventh embodiment of image forming apparatus of the present invention.
Figure 15:
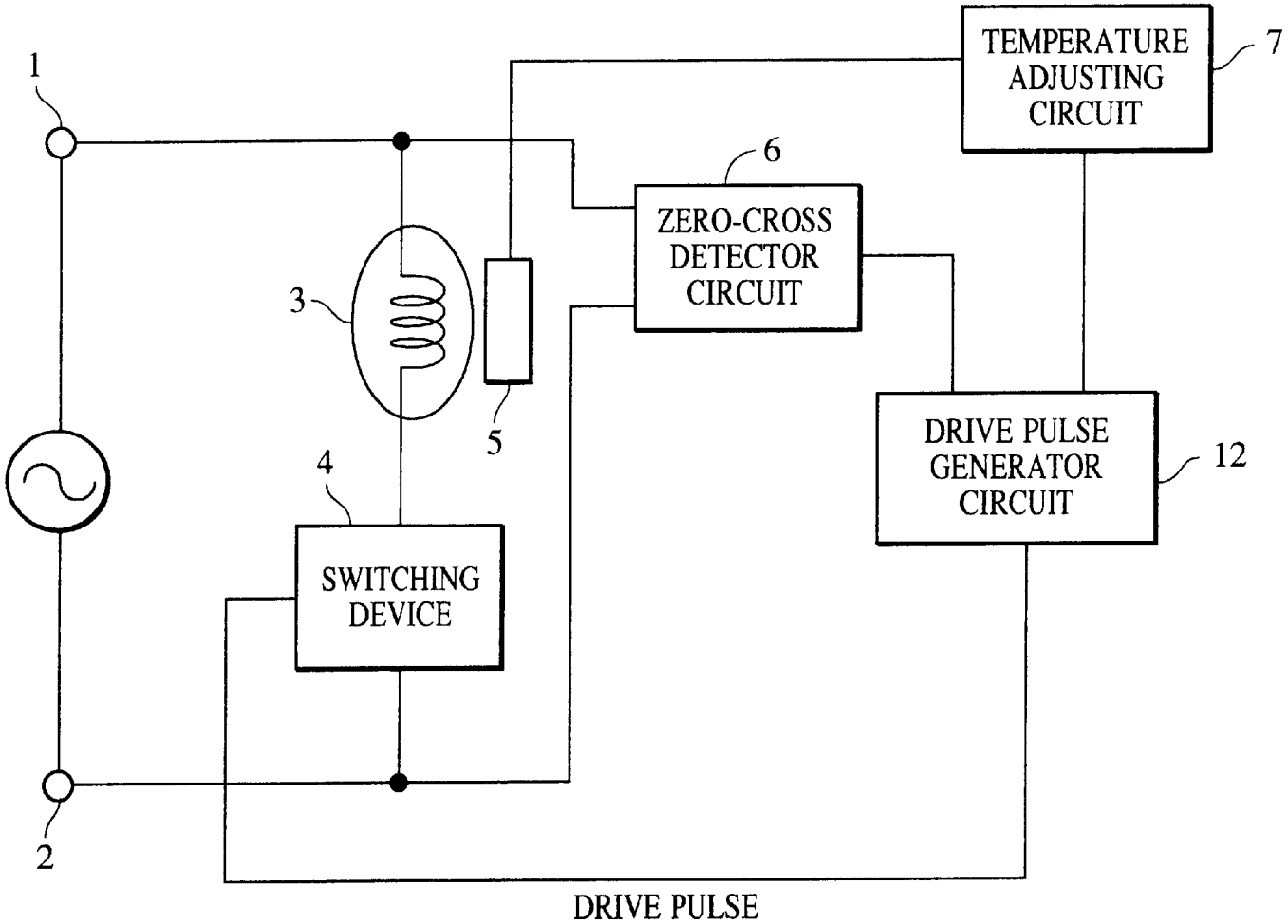
FIG. 15 is a block diagram showing a major portion of a conventional image forming apparatus.

Referring now to FIG. 14, a seventh embodiment of the present invention is discussed. FIG. 14 is a block diagram showing the construction of a heater control circuit of a seventh embodiment of the present invention. As shown, components identical to those described with reference to FIGS. 7, 11 and 13 are designated with the same reference numerals.

In the fourth embodiment in FIG. 7, the two heaters employed repeat conduction and non-conduction actions during the on (high level) period of the heater on/off signal output by the temperature adjusting circuit 7. In the embodiment shown in FIG. 14, a single heater 3*a* repeats its conduction and non-conduction actions.

Referring to FIG. 14, a drive pulse generator 411*a* generates a drive pulse for the switching means 4*a* which powers the heater 3*a* for conduction and non-conduction operations. The drive pulse generator 411*a* is identical in construction to that shown in FIG. 7.

In the control in which the switching means 4*a* is periodically turned on and off at short intervals during the on (high-level) period of the heater on/off signal output by the temperature adjusting circuit 7, the temperature drop of the heater (thus resistance value drop) is not so large in a short off time, and a second rush current flowing at the on time subsequent to the short off time is marginal. Only when the off state of the heater on/off signal output by the temperature adjusting circuit 7 continues for a predetermined time, power to the heater 3*a* is restricted through phase control during the on period. The flickering is thus controlled.

If the pulse drive generator 411*a* in FIG. 14 has the construction identical to that of the drive pulse generator 211*a* in FIG. 11, the duration of phase control will be able to be adjusted depending on the off time of the detected heater on/off signal, as in the fifth embodiment. If the pulse drive generator 411*a* in FIG. 14 has the construction identical to that of the drive pulse generator 311*a* in FIG. 13, the conducting angle during the phase control duration will be able to be adjusted depending on the off time of the detected heater on/off signal, as in the sixth embodiment. In this case, the phase control duration may be concurrently adjusted. Thermal energy may be efficiently supplied to the fixing roller while the flickering is controlled.

According to the present invention, the off-time detector circuit 13*a* detects the off time of the heater on/off signal output by the temperature adjusting circuit 7. Alternatively, the off time of the drive pulse 1 output by the selector 10*a* may be equally used.

The present invention is not limited to the above embodiments, and a variety of changes and modifications are possible without departing from the scope of the appended claims.

What is claimed is:

1. A heater control device comprising:

a heater for heating a load;

a sensor for detecting the temperature of the load heated by said heater;

a temperature adjusting circuit for generating a control signal that controls the driving of said heater so that the output of said sensor falls within a target temperature range;

a first generator circuit for generating a driving pulse that phase-controls said heater at a fixed phase angle;

a second generator circuit for generating a drive pulse that drives said heater at a full-rated power; and a selector circuit for selecting the drive pulse from said first generator circuit so that said heater is driven by the drive pulse from said first generator circuit for a duration from the start of the driving and selecting the drive pulse from said second generator circuit after the duration elapses each time said heater is driven in response to the control signal output by said temperature adjusting circuit.

2. A heater control device according to claim 1 further comprising a detector circuit for detecting a zero crossing of an alternating current supplied to the heater, wherein the first generator circuit generates the drive pulse such that the drive pulse and the timing of the zero crossing detected by the second detector means are synchronized to each other but with a predetermined phase difference introduced therebetween.

3. A heater control device comprising:

a heater for heating a load;

a sensor for detecting a temperature of the load heated by said heater;

a switching element for turning on and off an alternating current supplied to said heater;

a temperature adjusting circuit for giving to said switching element a stop instruction and a start instruction for the driving of said heater so that the output of said sensor comes to within a target temperature range; and driving means for phase-controlling said heater at a fixed phase angle for a duration from the start of the driving of said heater switching from phase-controlling to non-phase-controlling after the duration elapses each time the start instruction for the driving of said heater is given by said temperature adjusting circuit.

4. A heater control device according to claim 3 further comprising second detector means for detecting a zero crossing of the alternating current supplied to the heater, wherein the driving means generates a drive pulse for the phase controlling such that the drive pulse and the timing of the zero crossing detected by the second detector means are synchronized to each other but with a predetermined phase difference introduced therebetween.

5. A heater control device according to claim 3 further comprising image forming means for forming a toner image on a recording paper and fixing means for fixing the toner image onto the recording paper by heat generated by the heater, wherein the driving means makes a phase angle set for the phase controlling during an image forming operation larger than a phase angle set for the phase controlling during a non-image forming operation.

6. A heater control device according to claim 3, wherein the driving means switches to the non-phase controlling when the temperature detected by the sensor rises and reaches a predetermined temperature below the limit of the target temperature range.

7. A heater control device according to claim 3 further comprising detector means for detecting a non-conduction time of the heater, wherein the driving means phase-controls the heater for a second predetermined duration at a fixed phase angle from the start of the driving of the heater subsequent to the start instruction for the driving of the heater given by the temperature adjusting circuit when the non-conduction time detected by the detector means exceeds a first predetermined duration.

8. A heater control device according to claim 7, wherein the driving means drives the heater in the non-phase controlling subsequent to the start instruction for the driving of the heater given by the temperature adjusting circuit when the non-conduction time detected by the detector circuit is yet to exceed the first predetermined duration.

9. A heater control device according to claim 3 further comprising a first heater and a second heater, wherein the driving means drives the first heater in the phase controlling.

10. An image forming apparatus, comprising:

a first heater for heating a load;

a second heater for heating the load;

a sensor for detecting a temperature of the load heated by said first and second heaters;

a temperature adjusting circuit for generating a control signal that controls the driving of said first and second heaters so that the output of said sensor falls within a target temperature range;

a first drive pulse generator including:

a first generator circuit for generating a drive pulse that phase-controls said first heater;

a second generator circuit for generating a drive pulse that drives said first heater at a full-rated power; and a selector circuit for selecting the drive pulse from said first generator circuit so that said first heater is driven by the drive pulse from said first generator circuit for a duration from the start of the driving when said first heater is driven in response to the control signal output by said temperature adjusting circuit;

a second drive pulse generator for driving said second heater; and a control means for conduction control of said first and second heaters.

11. An image forming apparatus according to claim 10, further comprising an off-time detector for outputting a low-level signal to said second generator circuit when a predetermined time elapses.

12. An image forming apparatus according to claim 10, wherein said control means stores a plurality of heater conduction control programs, and determines whether the apparatus is in a standby mode or a copy/print mode, and determines the size of the recording paper when the apparatus is in the copy/print mode.

13. An image forming apparatus according to claim 12, wherein said control means controls the conduction by outputting control signals to said first and second drive pulse generators.

* * * * *

UNITED STATES PATENT AND TRADEMARK OFFICE

CERTIFICATE OF CORRECTION

PATENT NO. : 6,157,010
DATED : December 5, 2000
INVENTOR(S) : Ryuta Mine

It is certified that error appears in the above-identified patent and that said Letters Patent is hereby corrected as shown below:

Title page, item [57], Abstract:
Line 1, "a flickering" should read -- flickering --.

Sheet No. 7:
Figure 7, "PALSE" (both occurrences) should read -- PULSE --.

Sheet No. 11:
Figure 11, "PALSE" (both occurrences) should read -- PULSE --.

Sheet No. 13:
Figure 13, "PALSE" (both occurrences) should read -- PULSE --.

Sheet No. 14:
Figure 14, "PALSE" should read -- PULSE --.

Column 1:
Line 27, "supplying" should read -- supplied --.

Column 7:
Line 62, "vicinity. for" should read -- vicinity; for --.

Column 10:
Line 17, "and is" should read -- and are --.

Column 14:
Line 27, "vicinity. for" should read -- vicinity; for --.

UNITED STATES PATENT AND TRADEMARK OFFICE

CERTIFICATE OF CORRECTION

PATENT NO. : 6,157,010
DATED : December 5, 2000
INVENTOR(S) : Ryuta Mine

It is certified that error appears in the above-identified patent and that said Letters Patent is hereby corrected as shown below:

Column 15:
Line 31, "lib" should read -- 11b --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*